US010662612B1

(12) United States Patent
Frost et al.

(10) Patent No.: US 10,662,612 B1
(45) Date of Patent: May 26, 2020

(54) MATERIAL HANDLING BUCKET APPARATUS AND METHOD FOR HANDLING APPLICATION MATERIAL WITH A LOADER

(71) Applicants: Stuart Anthony Frost, Powell, WY (US); David Michael Frost, Jr., Powell, WY (US); Wesley Robert Mangus, Powell, WY (US)

(72) Inventors: Stuart Anthony Frost, Powell, WY (US); David Michael Frost, Jr., Powell, WY (US); Wesley Robert Mangus, Powell, WY (US)

(73) Assignee: Axenox Corp., Powell, WY (US)

( * ) Notice: Subject to any disclaimer, the term of this patent is extended or adjusted under 35 U.S.C. 154(b) by 0 days.

(21) Appl. No.: 16/721,620

(22) Filed: Dec. 19, 2019

(51) Int. Cl.
*E02F 3/413* (2006.01)
*E02F 3/36* (2006.01)

(52) U.S. Cl.
CPC ..... *E02F 3/4133* (2013.01); *E02F 3/3681* (2013.01)

(58) Field of Classification Search
CPC ..... E02F 3/3408; E02F 3/3417; E02F 3/3681; E02F 3/401; E02F 3/402; E02F 3/404; E02F 3/4075; E02F 3/4133
USPC ..... 37/184, 185, 406, 409, 442; 414/726
See application file for complete search history.

(56) References Cited

U.S. PATENT DOCUMENTS 1,882,489 A * 10/1932 Emerick ..... B66C 3/12 37/184
3,148,465 A * 9/1964 Beyerstedt ..... E02F 3/4133 37/409
3,209,474 A * 10/1965 Artman ..... E02F 3/404 37/409
3,341,041 A * 9/1967 Salna ..... E02F 3/3408 414/726
3,845,870 A * 11/1974 Balderson ..... E02F 3/401 37/442
4,706,762 A * 11/1987 Harms ..... E02F 3/963 172/684.5
8,006,414 B2 * 8/2011 Leonard ..... E02F 3/965 37/406

* cited by examiner

*Primary Examiner* — Saul Rodriguez
*Assistant Examiner* — Brendan P Tighe
(74) *Attorney, Agent, or Firm* — MacBride Law, PLLC; William L. MacBride, Jr.

(57) ABSTRACT

A material handling bucket apparatus and method comprising a material handling bucket having a bucket front half to haul application material, a horizontally sliding mechanism allowing the bucket front half to slide horizontally, a pair of linkage systems secured to the bucket front half, a loader tractor, a boom, a hydraulic power unit, and a power source. The pair of linkage systems laterally move the bucket front half forward beyond and independent of the opposing bucket back half, parallel to the ground surface, leaving the opposing bucket back half tilted back to be loaded. The bucket front half slides forward; and pivots upward to open with respect to the opposing bucket back half and subsequently reversing or pivoting downward to close against the opposing bucket back half, allowing the material handling bucket to doze, having the bucket front half to slide forward to scoop more application material.

30 Claims, 16 Drawing Sheets

MATERIAL HANDLING BUCKET APPARATUS AND METHOD FOR HANDLING APPLICATION MATERIAL WITH A LOADER

FIELD OF THE INVENTION

This patent disclosure relates to a material handling bucket apparatus operated by a loader tractor and a method for handling application or surface material with a loader.

BACKGROUND OF THE INVENTION

Buckets applied to loader earthmovers or tractors, or front end loaders, for handling materials are common in the industry. These conventional material buckets for loaders are applied for handling, scraping and loading surface or application materials, such as dirt and asphalt, and material handling operations including leveling, grading, hauling, front-end loading, clam shell operating, and bulldozing. However, there has been a recognized need, such as in the loader material handling industry, for a material handling bucket allowing an operator to neatly load material while simultaneously operating multiple loader controls, and doing so without spilling application material out of the front and side of the bucket.

The need for increased bucket maneuverability and handling capacity have been recognized. Conventional material handling buckets require heavy and expensive rocker arm linkages to pivot the bucket relative to the loader boom or lifting arm. Other conventional material handling buckets, while having in some instances a two-section bucket arrangement in a pivoting configuration, still have the disadvantage of being limited in lateral scope for loading and in their loading capacity, for handling application material, being confined to angular adjustments.

Additionally, the problem of material spillage off the sides of the dozer portion of a bucket has long been recognized.

As well, the mechanical problem of bucket side gates being in the way for offloading during traditional loader bucket use has long been recognized.

In the construction industry, the current, conventional standard for material handling buckets is the so-called "4-in-1 bucket", having a single pivot point of which the clam portion of the bucket, the bucket front half in a two section bucket, hinges in a radial, pivoting manner. In order to scrape a ground surface in a parallel, lateral manner the operator must, simultaneously tilt the dozer section, or the bucket back half, and close the clam, or bucket front half, in a proper sequence and rate. This is difficult and imprecise process for most operators.

When a clam, or front bucket section or half, is closed against the bucket back half and still in contact with the ground surface, the conventional bucket is not tilted in the fully loaded position which allows for material spillage out the front of the bucket in conventional material handling bucket apparatus. Again, the clam shell or bucket front half in these conventional earthmovers and loaders has limited lateral reach on the ground surface due to the fixed pivot point in the two section bucket. In the conventional, current prior art the bucket during the hauling process is laid down when the application material is scooped or gathered, and the material then will spill out when the bucket closes. Removable containment side gates could enhance the capabilities of the bucket by keeping application material contained in the bucket without spillage outside of the dozer, the bucket back half section.

The current clam shell type, two section buckets found in the construction industry only pivot on a singular axis, open and close. A need has been recognized to provide an operator with the ability to doze application material with the bucket back half section, with the clam portion, the bucket front half section, being open, then to close the clam, bucket front half, down on the bucket back half in order to gather a higher volume of a load of the application material.

The references described in the related art do not disclose features of the present invention and would not be as suitable for the required purpose of the present invention hereinafter described. Material bucket handling apparatuses for loaders and earthmovers are found in the related art, exemplified by U.S. Pat. No. 4,706,762 to Harms et al. ("Harms") and U.S. Pat. No. 3,341,041 to Salna ("Salna"). Harms discloses a bucket having slots that allow for horizontal travel of a leveling device. Salna discloses a bucket with a pivot allowing moving material from a clam shell; there is no horizontal travel of the clam shell relative to the bucket. The references described in the related art do not disclose features of the present invention, including, a linkage provided on the sides of the bucket including a pair of parallel slots for connecting the clam to the bucket and extending the reach of the clam, the clam adapted to travel parallel to the ground surface and then pivot upwardly at the end of travel. As well, Salna discloses a bucket having a front and rear (or back) sections (or halves) pivoting about a common axis.

None of the prior art references suggest the present invention. Although Harms discloses a slot provided on the sides of a leveling device, the slot is for the purpose of pushing downwardly. While Salna discloses a clam and bucket, the pivot in Salna is fixed and does not extend the reach of the clam in a direction parallel to the ground. Neither of these references suggest, teach or support combining with, modifying, each other or any other reference in a manner that would suggest the present invention, or would otherwise function in the manner of the present invention.

None of the references in the prior art contain every feature of the present invention, and none of these references in combination disclose, suggest or teach every feature of the present invention. The present invention is neither disclosed nor suggested by the prior art.

The foregoing and other objectives, advantages, aspects, and features of the present invention will be more fully understood and appreciated by those skilled in the art upon consideration of the detailed description of a preferred embodiment, presented below in conjunction with the accompanying drawings.

SUMMARY OF THE INVENTION

The present invention is a material handling bucket apparatus comprising a material handling bucket having a bucket front half, having a dozer bottom, and a dozer scraping lip, and configured to haul application material such as dirt, snow, or concrete, as well as a horizontally sliding mechanism allowing the bucket front half to slide horizontally with respect to an opposing bucket back half. The opposing bucket back half sets snugly and pivotally within the bucket front half. The material handling bucket apparatus further comprises a loader having a loader tractor, a pair of loader operating lifting arms, a pair of loader operating tilt arms, a hydraulic power unit, a pair of loader attaching points, a pair of tilt attaching points, and a power source. A plurality of loader attachment means operationally attach the pair of loader operating tilt arms to the opposing bucket back half. The loader tractor to the loader provides power from the power source to the pair of loader operating tilt arms and the loader operating lifting arms. The loader employs a hydraulic power unit and power source, including a control means, having a control circuit and controls for operating the loader and the material handling bucket. The control means operate with the hydraulic power unit to direct hydraulic fluid under pressure to a pair of front bucket actuating cylinders, elements of the pair of linkage systems pivotally and cooperatively joined to the bucket front half.

In alternative embodiments of the present invention, the pair of linkage systems further comprise a pair of front linkage arms cooperatively and pivotally connected a pair of central linkage arms which, in turn, are connected to a pair of rear linkage arms which, in turn are connected to the pair of front bucket actuating cylinders causing the pair of linkage systems to operate the front bucket half.

The bucket front half operates and moves in a pivoting manner over and forward of the opposing bucket back half. The pair of linkage systems are secured to the bucket front half, and laterally move the bucket front half forward beyond the dozer scraping lip of the opposing bucket back half allowing it to haul the application material backward onto the opposing bucket back half. The loader tips the opposing bucket back half up and down to dump application material, and lifts, pivots, pushes, and pulls the opposing bucket back half forward, backward, upward and downward.

In an alternative embodiment of the present invention, the horizontally sliding mechanism comprises a plurality of secured horizontally sliding pins attaching permanently within the bucket front half A plurality of substantially horizontal sliding slots are engaged within the plurality of substantially horizontal sliding slots through the opposing bucket back half, providing horizontal and pivotal movement of the plurality of secured horizontally sliding pins, allowing the bucket front half to pivot and to advance forward, backward, upward and downward with respect to the opposing bucket back half.

In alternative embodiments, the plurality of secured horizontally sliding pins comprise a plurality of pin bearings allowing for easy horizontal movement within the plurality of substantially horizontal sliding slots.

In alternative embodiments of the present invention, the pair of linkage systems further comprise a pair of front linkage arms cooperatively and pivotally connected a pair of central linkage arms which, in turn, are connected to a pair of rear linkage arms which, in turn are connected to the pair of front bucket actuating cylinders causing the pair of linkage systems to operate the front bucket half.

Alternative embodiments of the present invention include a pair of side gates attached to the left bucket side and the opposing right bucket side of the opposing bucket back half. In another alternative embodiment, the pair of side gates are attached by a pair of side gate adjuster bars. A pair of stabilizer bars support and operate the pair of side gates independent of the bucket front half.

In an alternative embodiment of the present invention, the material handling bucket apparatus comprises a loader having a loader tractor, a boom, a hydraulic power unit, and a power source, and a material handling bucket having a bucket front half and an opposing bucket back half, a left bucket side and an opposing right bucket side, as well as the horizontally sliding mechanism cooperatively adjoining the bucket front half with the opposing bucket back half allowing the bucket front half to slide horizontally and cooperatively with respect to the opposing bucket back half A pair of linkage systems are pivotally and cooperatively joined to the bucket front half.

Another alternative embodiment of the material handling bucket apparatus comprises the boom having the pair of loader operating lifting arms, the pair of loader operating tilt arms, the pair of loader attaching points, and the pair of tilt attaching points.

Current related art provides clamshell buckets that only pivot on a singular axis, in order to open and close. One objective of the present invention, is for the pair of linkage systems, located on each of the pair of bucket sides, to enable the bucket front half, to travel forward, in the travel direction of the loader, independent of the opposing bucket back half, in a lateral direction parallel to the ground surface, while at the same time leaving the opposing bucket back half tilted back in a position to be loaded. The material handling bucket slides by the plurality of secured horizontally sliding pins attached to the bucket front half sliding within the plurality of substantial horizontal sliding slots in the opposing bucket back half, the bucket front half sliding and moving forward; and then pivoting upward to open with respect to the opposing bucket back half and subsequently reversing or pivoting downward to close against the opposing bucket back half, providing the material handling bucket with the ability to doze the application material, while having the bucket front half open or upward, and then slide the bucket front half forward, to further scoop more application material. The bucket front half can then be closed pivoting downward against the opposing bucket back half to contain the application material once it is loaded.

An objective of the present invention is to allow the pair of linkage systems to enable the bucket front half to travel forward, independent of the opposing bucket back half, parallel to the ground surface, while at the same time leaving and allowing the opposing bucket back half to remain tilted back, toward the loader in a position to be loaded.

Another objective of the present invention is for the pair of linkage systems to allow for easy loading of the application material without an operator having to simultaneously tilt the opposing bucket back half and retract the bucket front half, including: (I) the ability to cause the bucket front half to pivot upward and downward around the pair of front pivotally connecting points, while (ii) independently allowing the pair of loader operating lifting arms and the pair of loading tilt arms to cause the opposing bucket back half to move upward and downward (tilt), and forward and backward (roll).

Another objective of the present invention is to have the material handling bucket apparatus easily loaded with application material by a single control input at the control means. The pair of side gates allow application material to be gathered in front of the dozer scraping lip without spilling outside the side edges. The plurality of secured horizontally sliding pins permit the bucket front half to slide well forward of the opposing bucket back half and parallel to the ground surface and then pivot upwardly into an open position. Once the opposing bucket back half has dozed forward to load application material, the bucket front half is then retracted, gathering application material along the ground surface toward the opposing bucket back half. The application material is contained within the opposing bucket back half once the bucket front half is fully retracted The pair of linkage systems extends the reach of the bucket front half and allows the lower edge to travel flush with the ground with one simple control input, leaving the opposing bucket back half tilted back in the loaded position, carrying the application material.

In alternative embodiments of the present invention, the pair of side gates run parallel to the ground surface when the bucket front half is up and open and the opposing bucket back half is in a loaded position hauling application material.

An alternative embodiment of the present invention is a method for handling application material with a loader, the method comprising a loader having a loader tractor, a boom, a hydraulic power unit, a material handling bucket, a pair of linkage systems, and a power source which is operated with a control means, which in alternative embodiments provides for controls and a control circuit. The method further comprises providing the material handling bucket with a bucket front half (having a pair of front pivotally connecting points and a convexing clam front surface) and an opposing bucket back half (having a plurality of loader attachment means), the bucket front half moving independently of the opposing bucket back half, a dozer bottom, and a dozer scraping lip having a sharp scraping edge; pivotally joining the pair of linkage systems to the bucket front half at a pair of front connecting pins; and installing a horizontally sliding mechanism cooperatively adjoining the bucket front half with the opposing bucket back half allowing the bucket front half to slide horizontally with respect to the opposing bucket back half. The method further comprises operating and pivoting the bucket front half around the pair of front pivotally connecting points over and forward of a open top/front side the opposing bucket back half, allowing the bucket front half to pivot and to advance forward, backward, upward and downward with respect to the opposing bucket back half by allowing and providing horizontal and pivotal movement from the horizontally sliding mechanism. Hydraulic power is provided from hydraulic power unit to operate the pair of linkage systems. The pair of linkage systems laterally move the bucket front half forward beyond the bucket front half and allow for hauling application material from a ground surface backward onto a dozer surface panel in the opposing bucket back half. The method operationally locates the boom between the loader tractor and (and attaches it to) the opposing bucket back half, operating the opposing bucket back half with the loader, tipping the opposing bucket back half up and down to dump the application material. The boom is used to lift, pivot, push and pull the opposing bucket back half forward, backward, upward and downward. The method generates and provides power from the power source in the loader to power and move the loader tractor, to move the boom, to operate the hydraulic power unit, and causing the material handling bucket to operate. A pair of stabilizer bars are attached to the loader tractor by the plurality of loader attachment means and secured to a pair of side gates.

An alternative embodiment of this method of the present invention for handling surface material with a loader provides the pair of linkage systems with a pair of front linkage arms; a pair of central linkage arms, a pair of rear linkage arms, a pair of front bucket actuating cylinders, and a pair of hydraulic lines; all of which are limited, providing hydraulic power from the hydraulic power unit in the loader tractor operating the pair of linkage systems; and, ultimately, the front bucket half.

Another alternative embodiment of the present invention is a method for handling application material with a loader comprising a loader tractor, a boom, a material handling bucket, a pair of linkage systems, and a power source, operated with a control means. The method operates the bucket front half by the pair of linkage systems in a pivoting and lateral manner, pivoting over the opposing bucket back half, providing horizontal and pivotal movement by the horizontally sliding mechanism, moving the bucket front half forward beyond the bucket front half. The method operates the opposing bucket back half with the loader using a boom and tipping the opposing bucket back half up and down to load and dump application material, while using the boom to lift, pivot, push and pull the opposing bucket back half forward, backward, upward and downward. A pair of stabilizer bars are operatively attaching to the loader tractor by the plurality of loader attachment means, securing each of the pair of stabilizer bars to each of the pair of side gates, and freely supporting and operating the pair of side gates independent of the bucket front half and the opposing bucket back half. The pair of side gates are oriented horizontally to the ground surface, and neatly contain, the application material within the opposing bucket back half with the pair of side gates.

Advantages and objectives of the present invention include being able to neatly cut seams in the ground surface, for paving operations without spilling application material, reducing labor needed to clean spillage, neatly loading application material while simultaneously operating multiple controls in the loader, is solved by the uniquely shaped front bucket half, and the unique "parallel to ground linkage" provided by the pair of linkage systems. The reach of the material handling bucket is greatly extended with one control input having the opposing bucket back half tilted back in the loaded position. Spillage off the sides of the opposing bucket back half is prevented by the pair of side gates.

Another advantage and objective of the present invention is for collecting the application material along a roadway shoulder without spilling.

Another advantage and objective of the present invention is cleaning in tight areas in the traveled way, making roadway construction areas safer, keeping material handling equipment away from traffic.

Another advantage of the present invention is that the material handling bucket is optimal for snow removal without spilling into traffic, facilitated by the pair of side gates.

Another advantage of the present invention is that the material handling bucket apparatus is optimal for maintenance, landscaping, and agriculture, allowing for easily gathering and loading application material on the ground surface.

The aforementioned features, objectives, aspects and advantages of the present invention, and further objectives and advantages of the invention, will become apparent from a consideration of the drawings and ensuing description.

BRIEF DESCRIPTION OF THE SEVERAL VIEWS OF THE DRAWINGS

The foregoing features and other aspects of the present invention are explained and other features and objects of the present invention will become apparent in the following detailed descriptions, taken in conjunction with the accompanying drawings. However, the drawings are provided for purposes of illustration only, and are not intended as a definition of the limits of the invention.

Curved lead lines with a number indicate a side of the depiction that is not visible. An underlined number indicates the number is located on the area or surface of an element.

Figure 15:
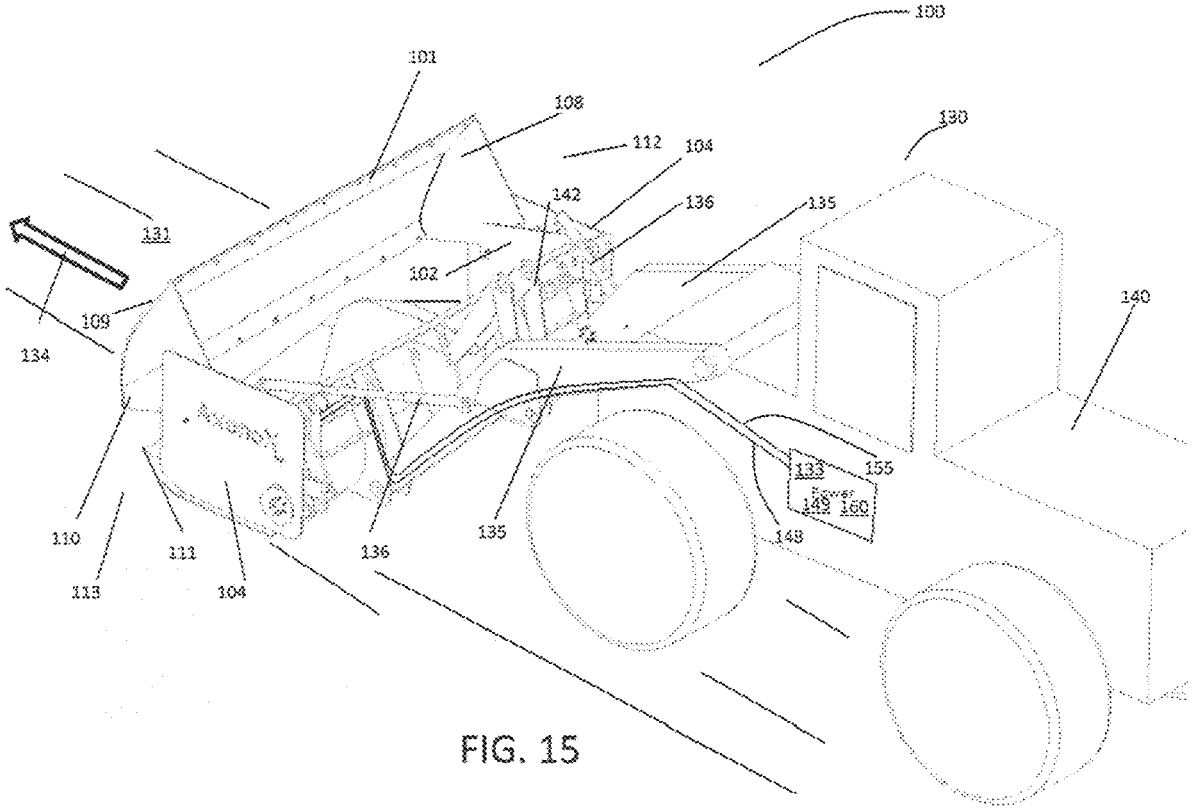
Figure 18:
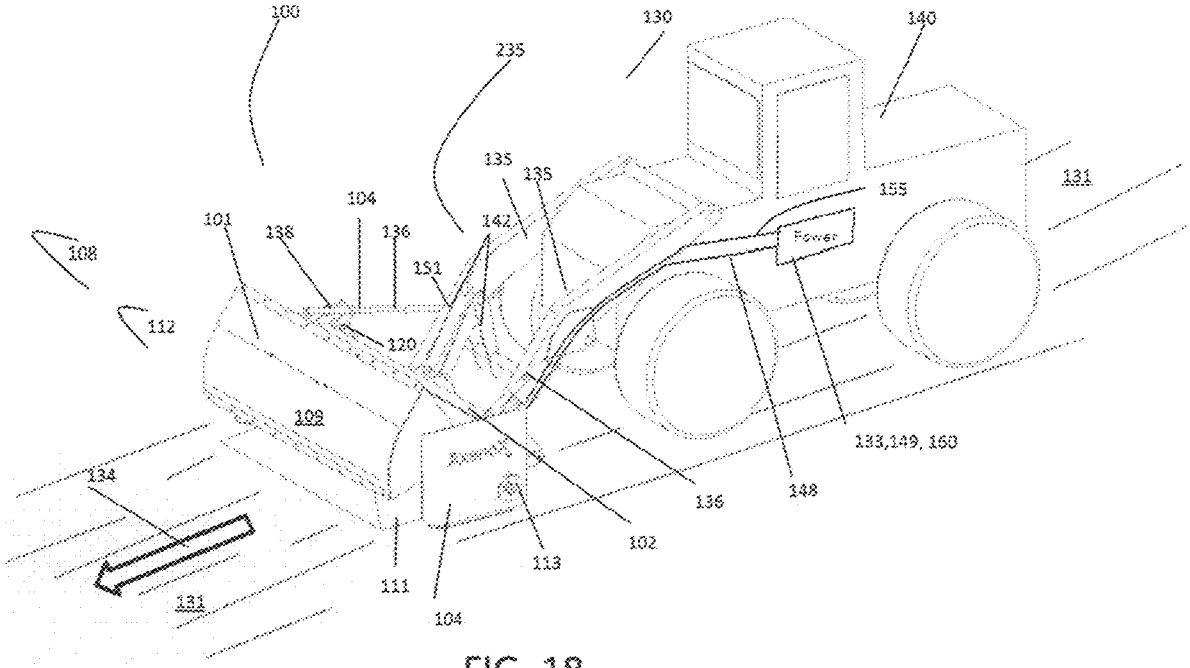

The box labeled "Power" shown in this figure and FIGS. 15 and 18 depicts, generally the power source and the hydraulic power unit for the loader. The numbered lines leading generally from the box labeled "Power" to the material handling bucket are, respectively, the pair of hydraulic lines and the plurality of power lines, which are understood to generally depict those respective lines.

Figure 2:
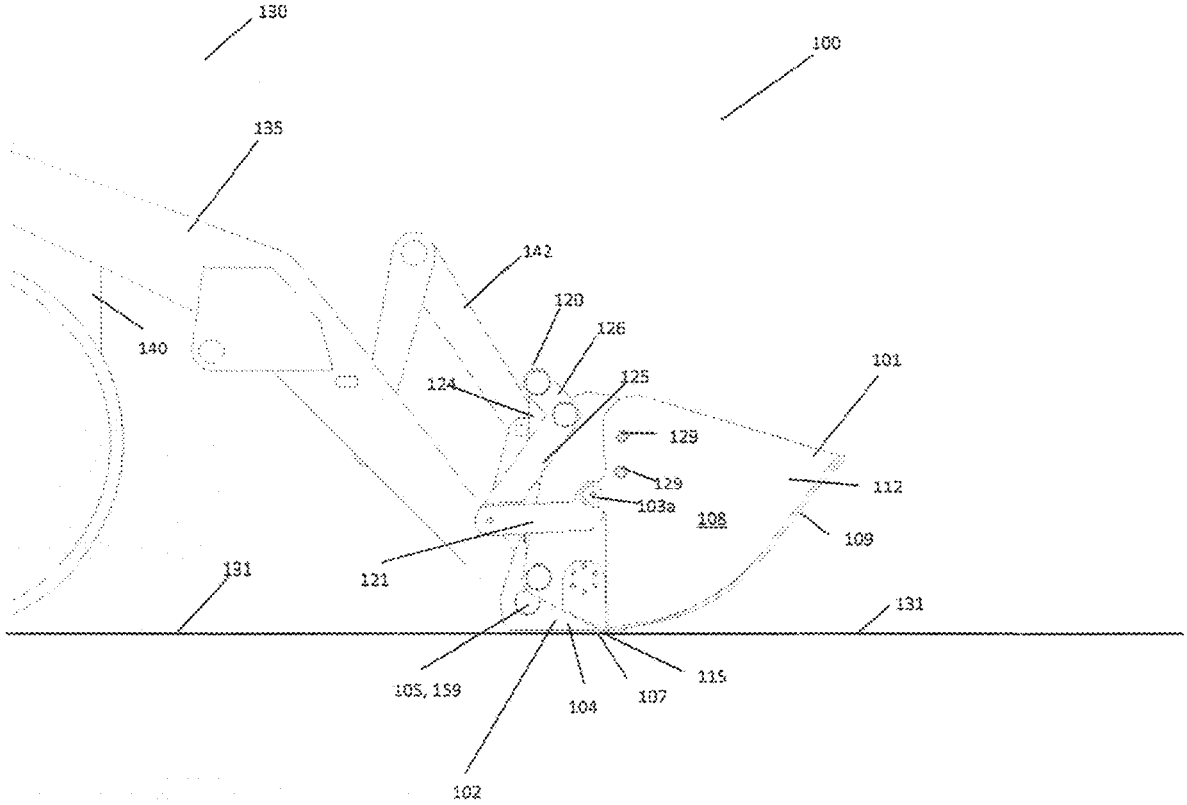

FIG. 2 illustrates a bucket left side elevational view of an embodiment of the present invention with a view of a portion of the loader and bucket front half pivoted downward to the ground surface.

Figure 3:
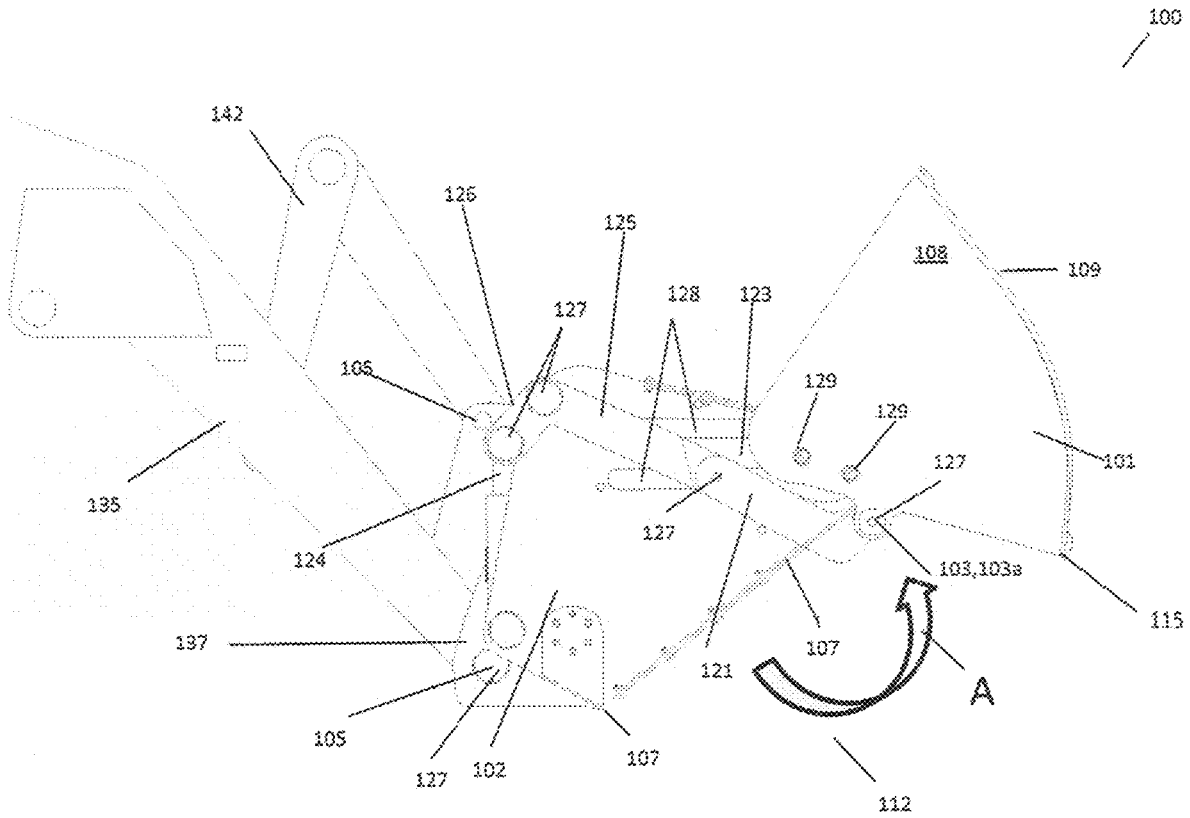

FIG. 3 illustrates a left bucket side elevational view of an embodiment of the present invention with a view of a portion of the loader and bucket front half pivoting upward. Direction of pivotal movement (A) is shown for the bucket front half around on of the plurality of linkage lugs.

Figure 4:
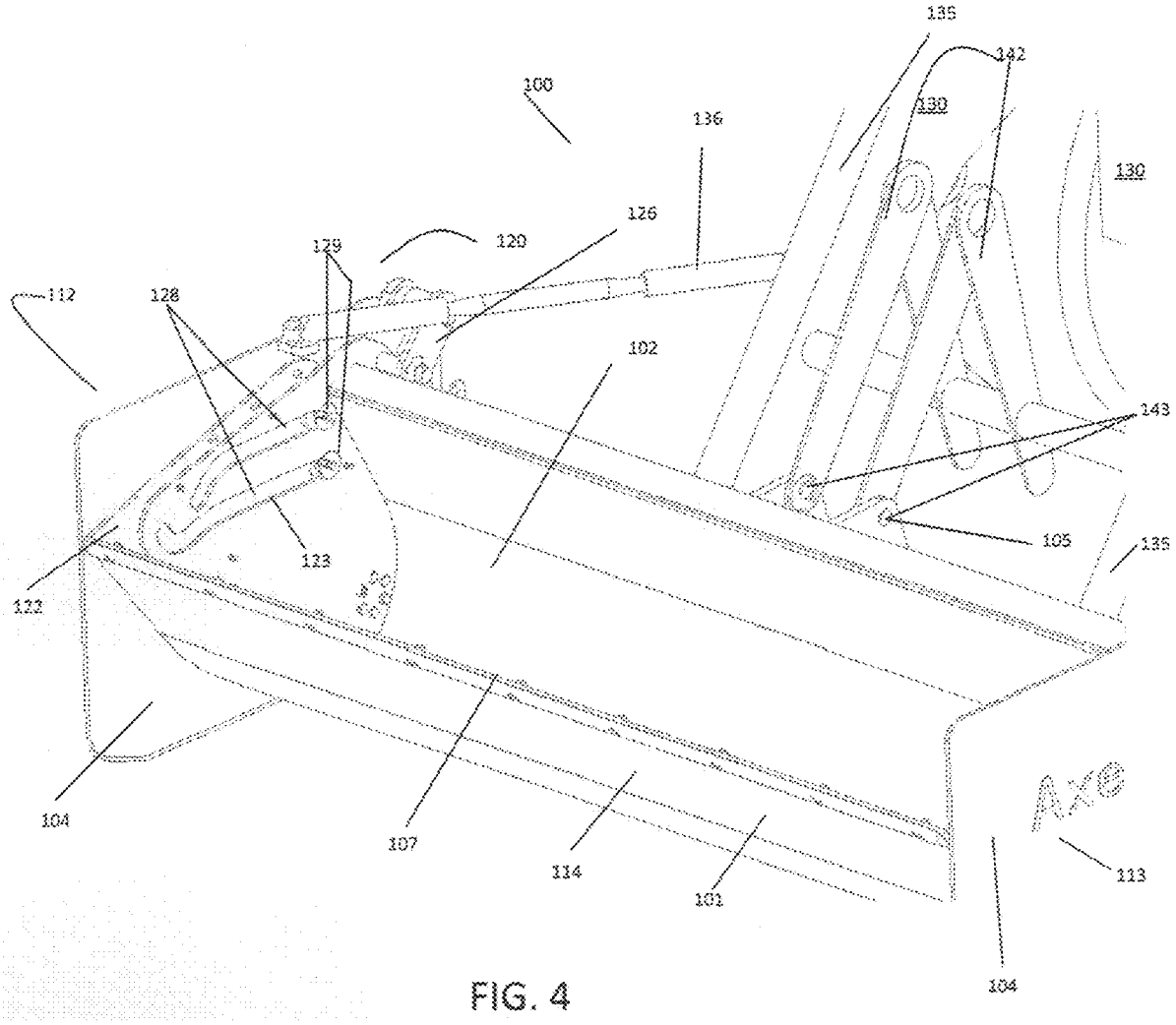

FIG. 4 illustrates a prospective view of an embodiment of the present invention depicting apportion of the material handling bucket and loader, showing the bucket front half pivoted downward around the opposing bucket back half and having the plurality of secured horizontally sliding pins within the plurality of substantially horizontal sliding slots.

Figure 5:
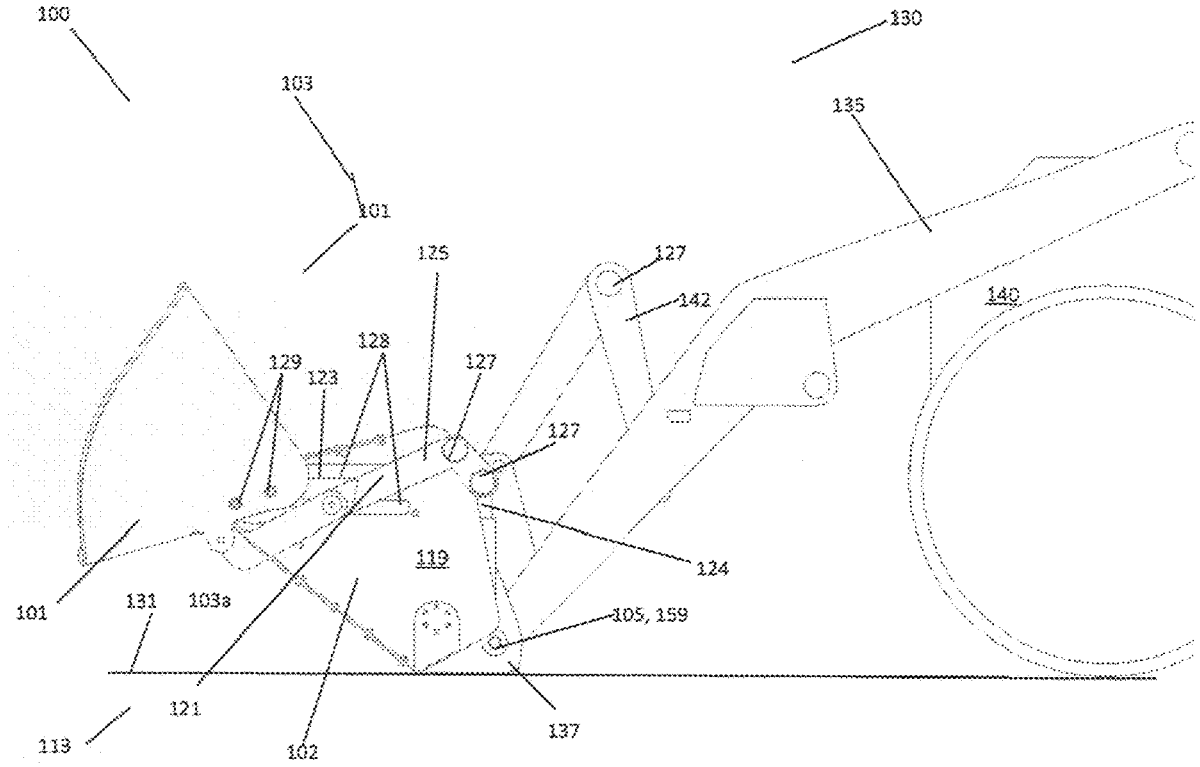

FIG. 5 illustrates opposing right bucket side elevational view of an embodiment of the present invention with a view of a portion of the loader, an opposing bucket back half pivoted upward and bucket front half pivoted upward.

Figure 6:
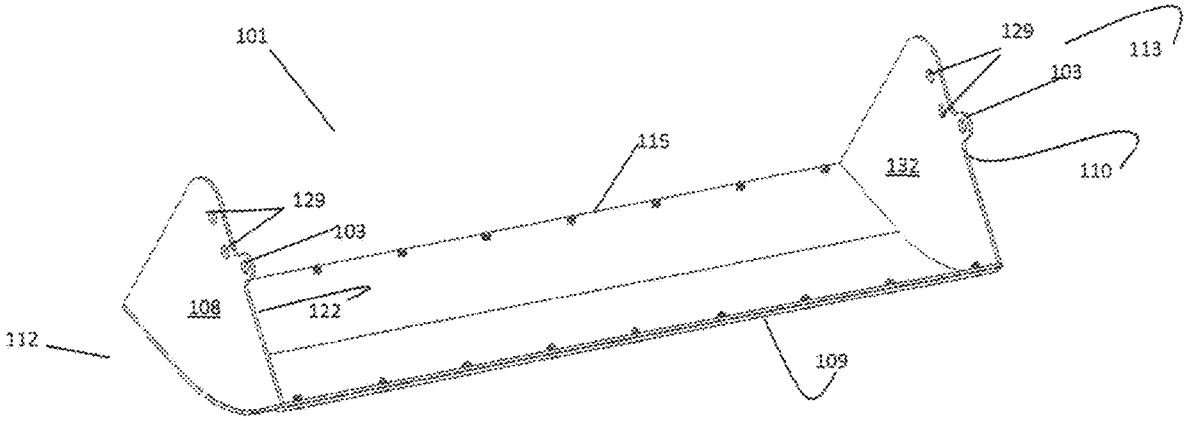
Figure 7:
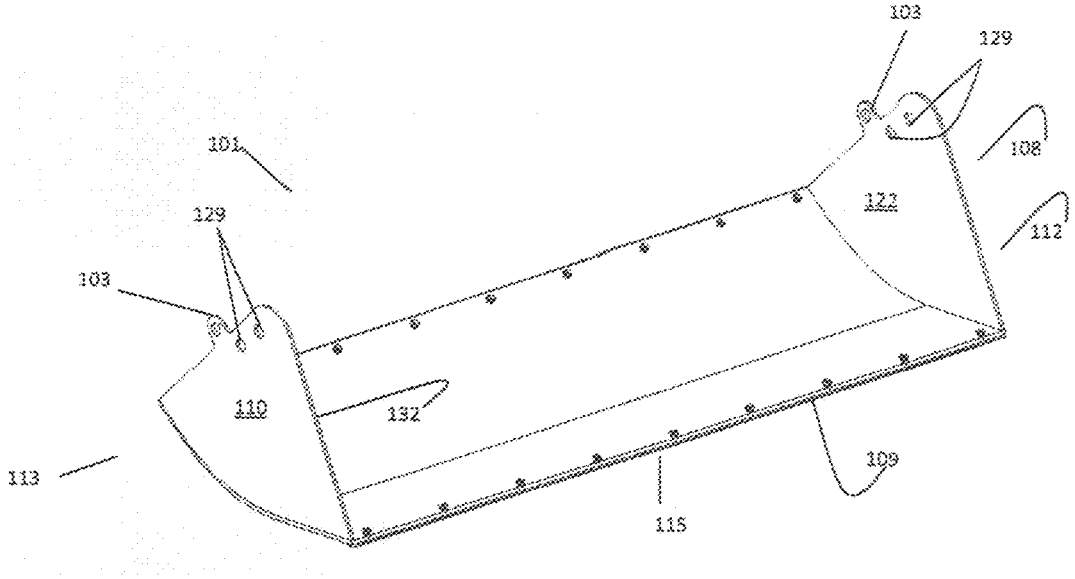
Figure 8:
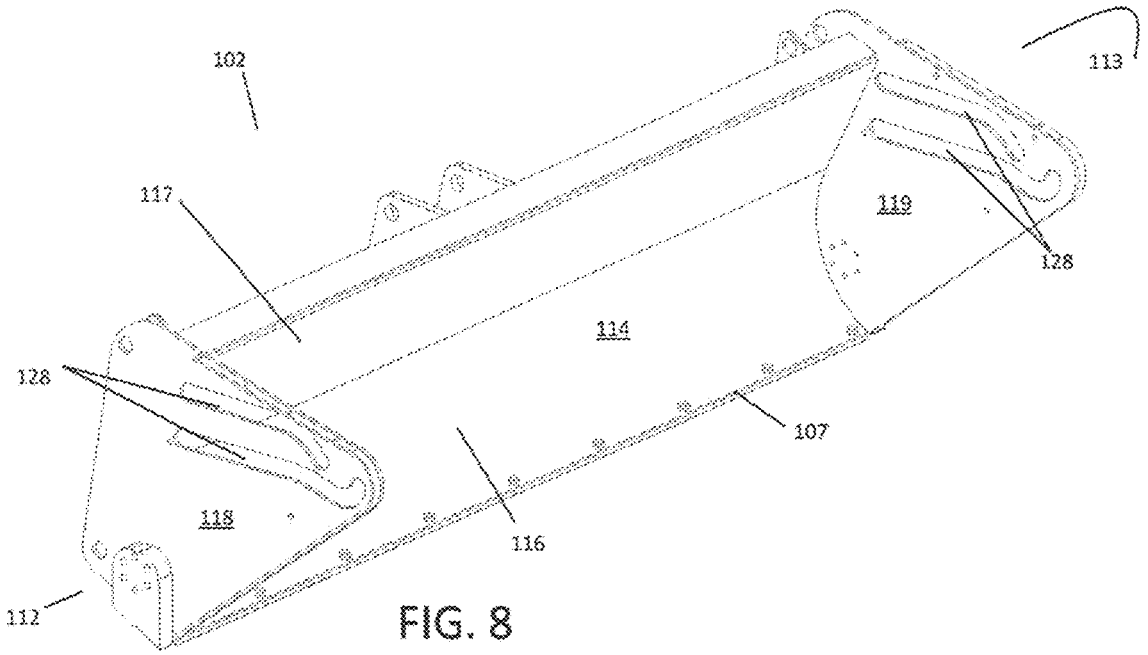
Figure 9:
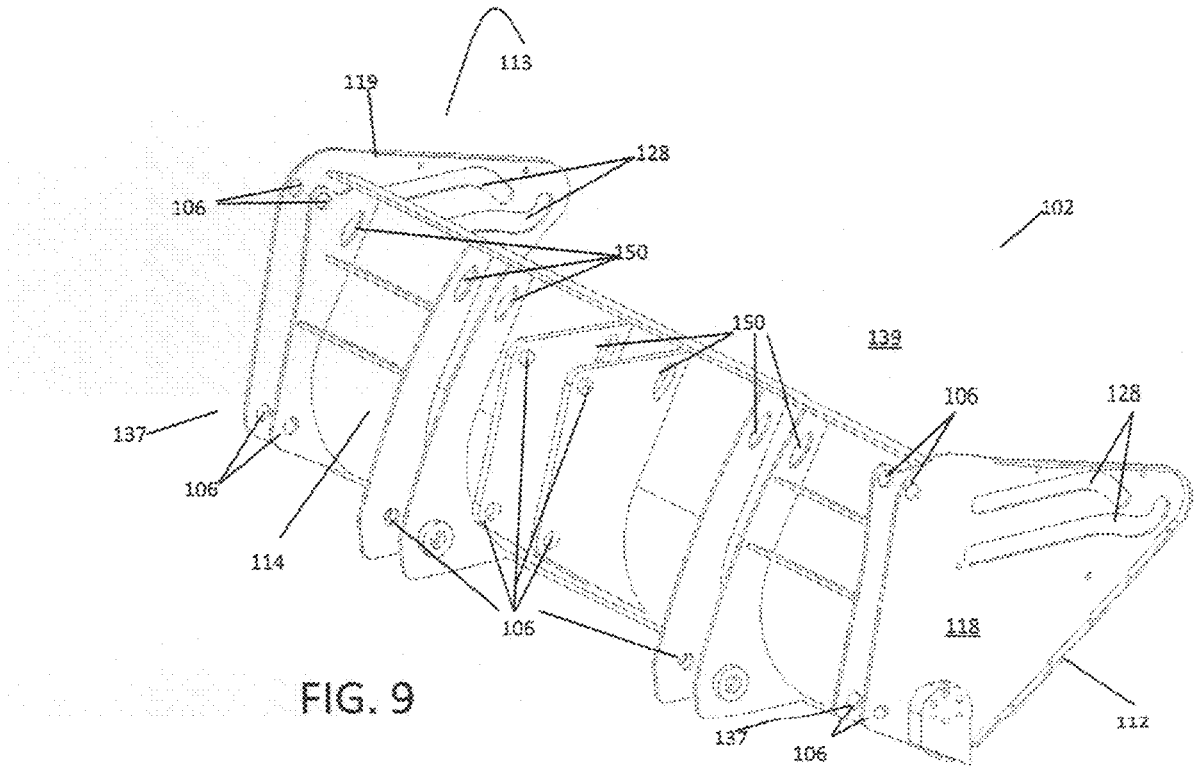

FIG. 6 illustrates a left bucket side perspective interior view of the bucket front half element of a portion of one embodiment of the present invention, FIG. 7 illustrates an opposing right bucket side perspective interior view of the bucket front half element of a portion of one embodiment of the present invention, FIG. 8 illustrates a left bucket side perspective interior view of the opposing bucket back half element of a portion of one embodiment of the present invention, FIG. 9 illustrates an opposing right bucket side perspective interior view of the opposing bucket back half element of a portion of one embodiment of the present invention, The general location of the open top/front side is indicated in the drawing by the underlined number 139.

Figure 10:
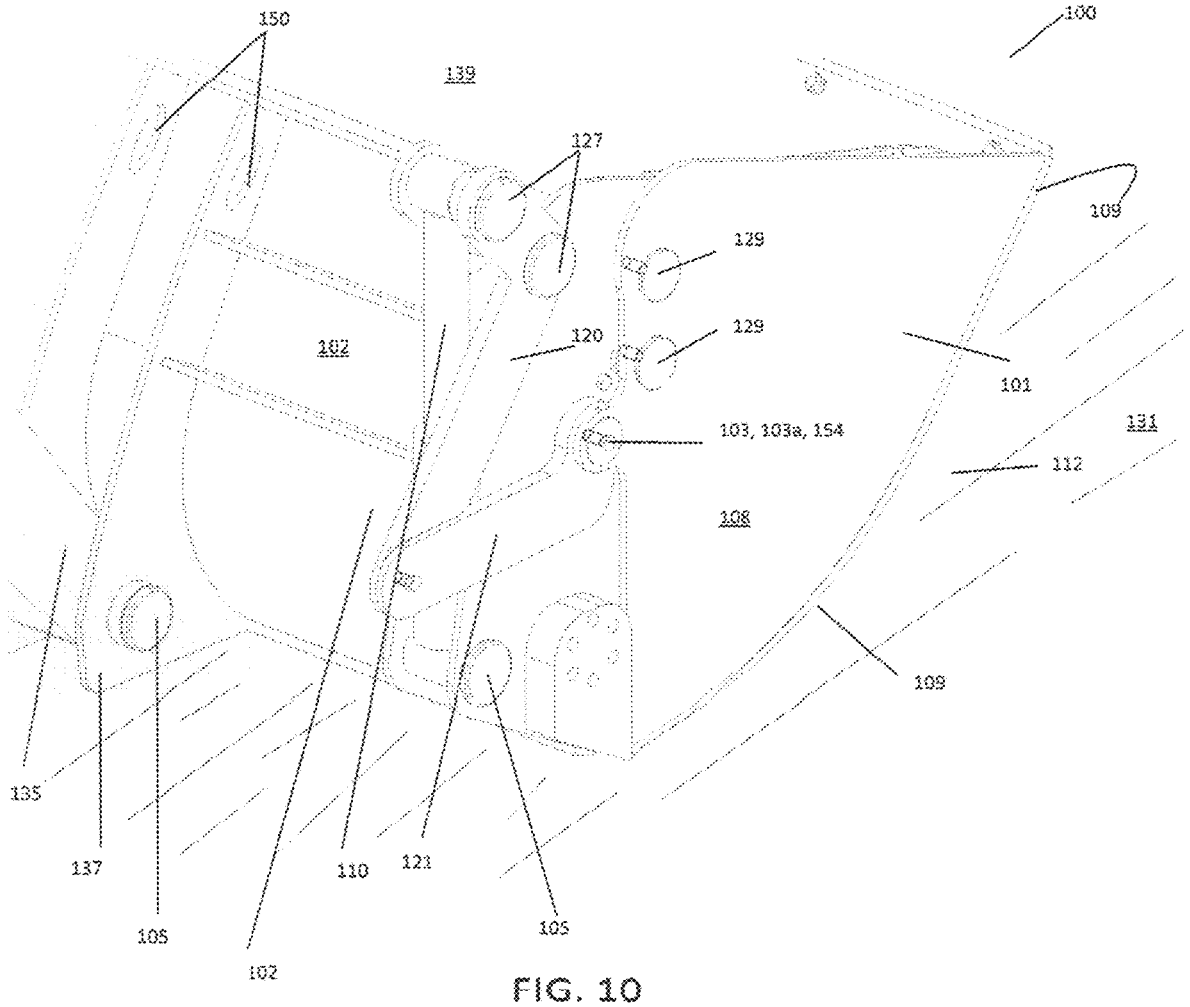

FIG. 10 illustrates a perspective view of a portion of the left bucket side of the material handling bucket apparatus to one embodiment of the present invention, depicting the material handling bucket and the attaching linkage system, showing the bucket front half pivoted downward around the opposing bucket back half and to the ground surface.

Figure 11:
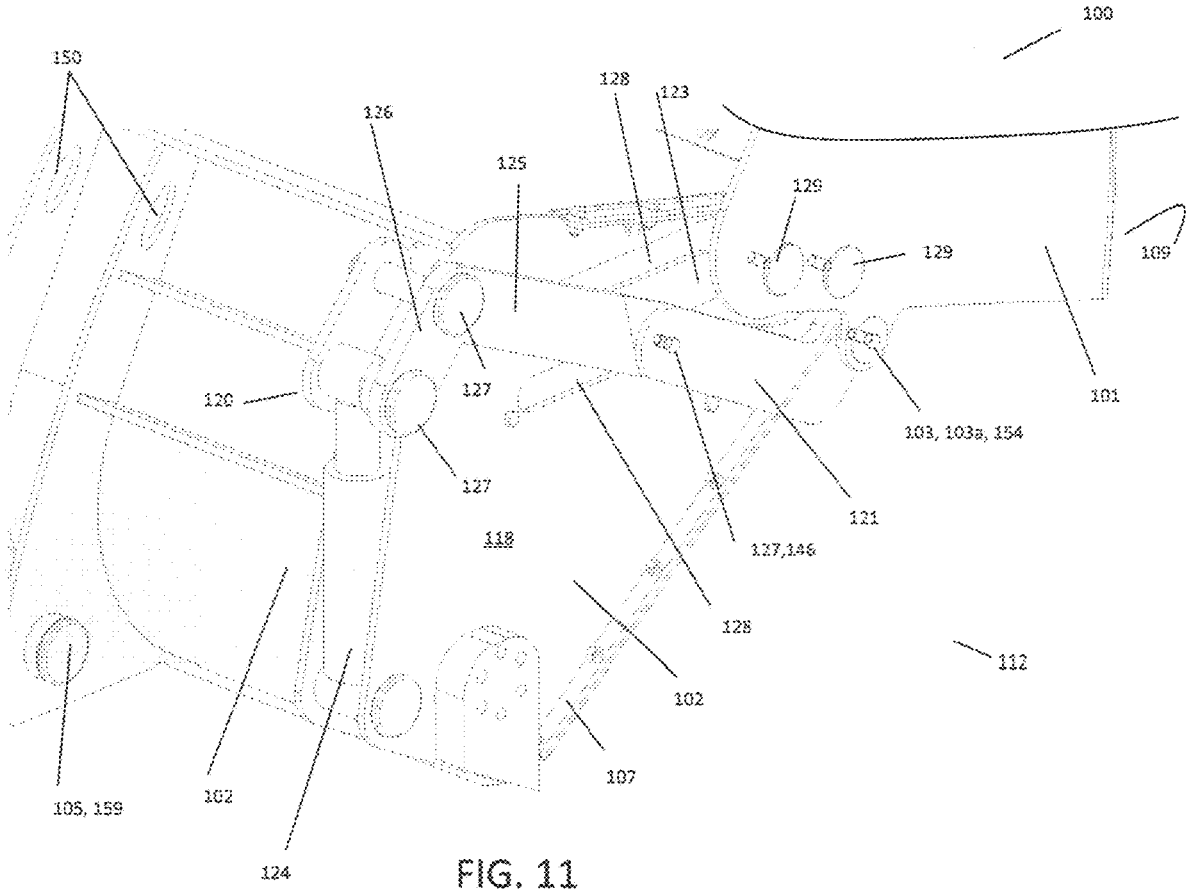

FIG. 11 illustrates a perspective view of a portion of the left bucket side of the material handling bucket apparatus to one embodiment of the present invention, depicting the material handling bucket and the attaching linkage system, showing the bucket front half pivoting upward.

Figure 12:
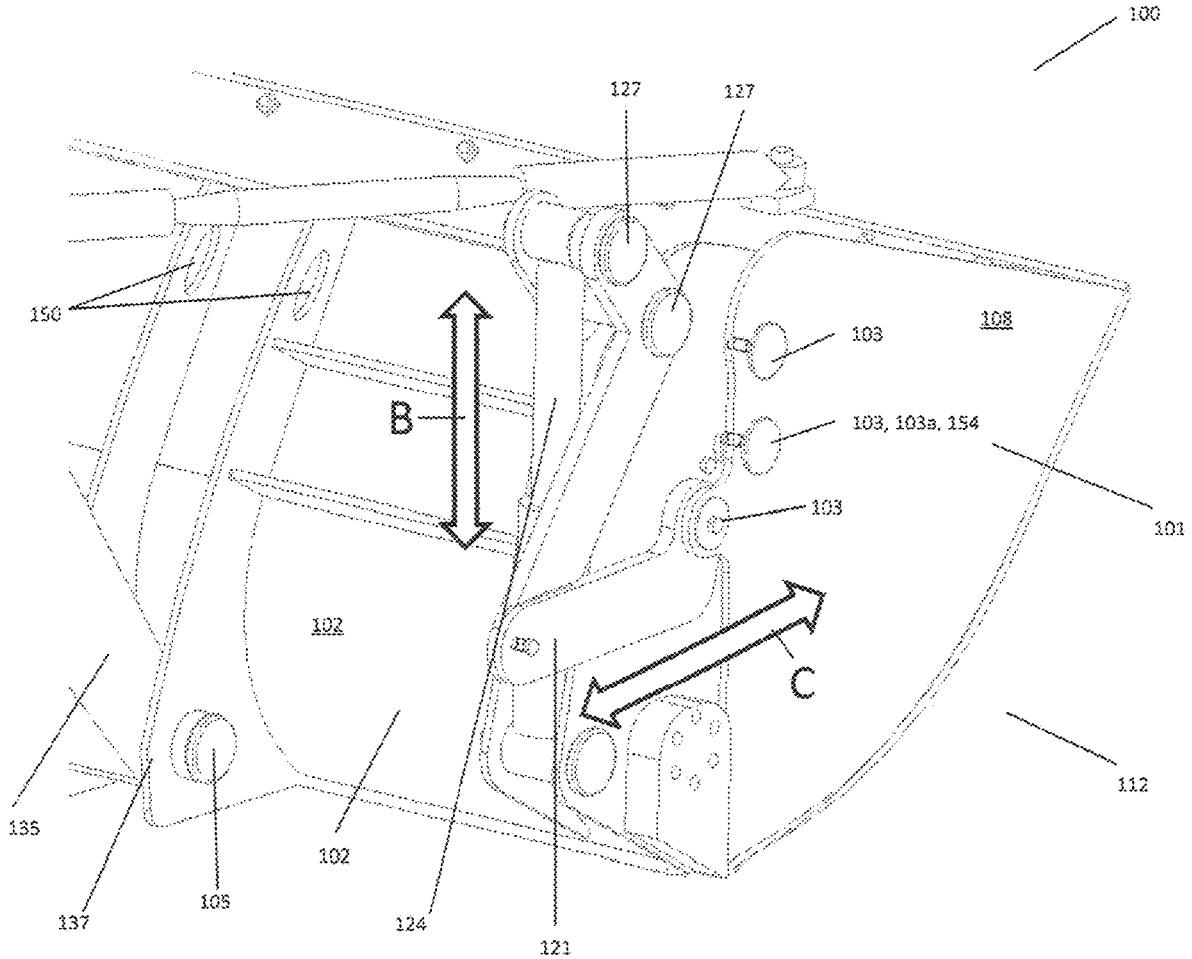

FIG. 12 illustrates a perspective view of a portion of the left bucket side of the material handling bucket apparatus in one embodiment of the present invention, depicting the material handling bucket and the attaching pair of linkage systems, showing the bucket front half pivoted downward around the opposing bucket back half and to the ground surface. Directions of vertical movement (B) and lateral or horizontal movement (C) are shown for the opposing bucket back half.

Figure 13:
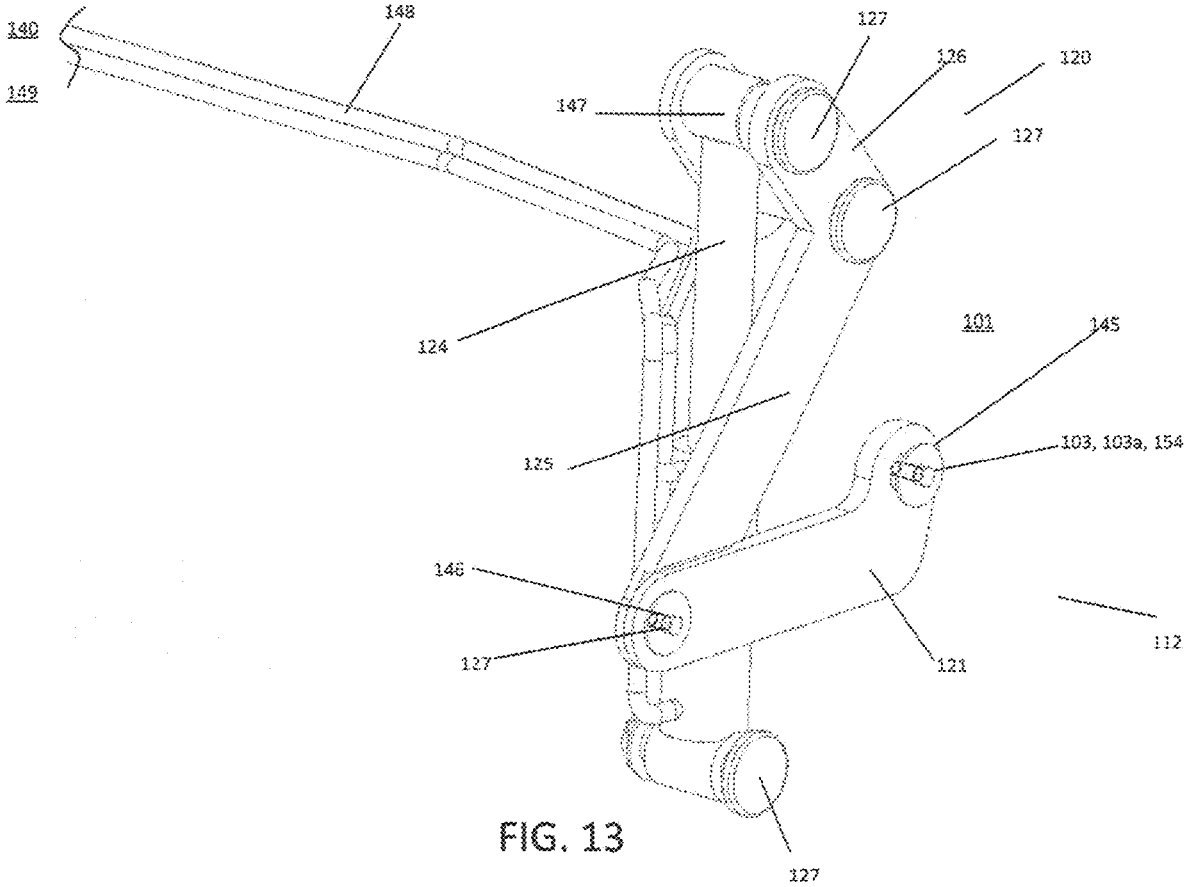

FIG. 13 illustrates a perspective view of the left bucket side of the pair of linkage systems element to the material handling bucket apparatus of a portion of one embodiment of the present invention. The general location of the loader tractor, hydraulic power unit, and front bucket half are indicated in the drawing by the underlined numbers.

Figure 14:
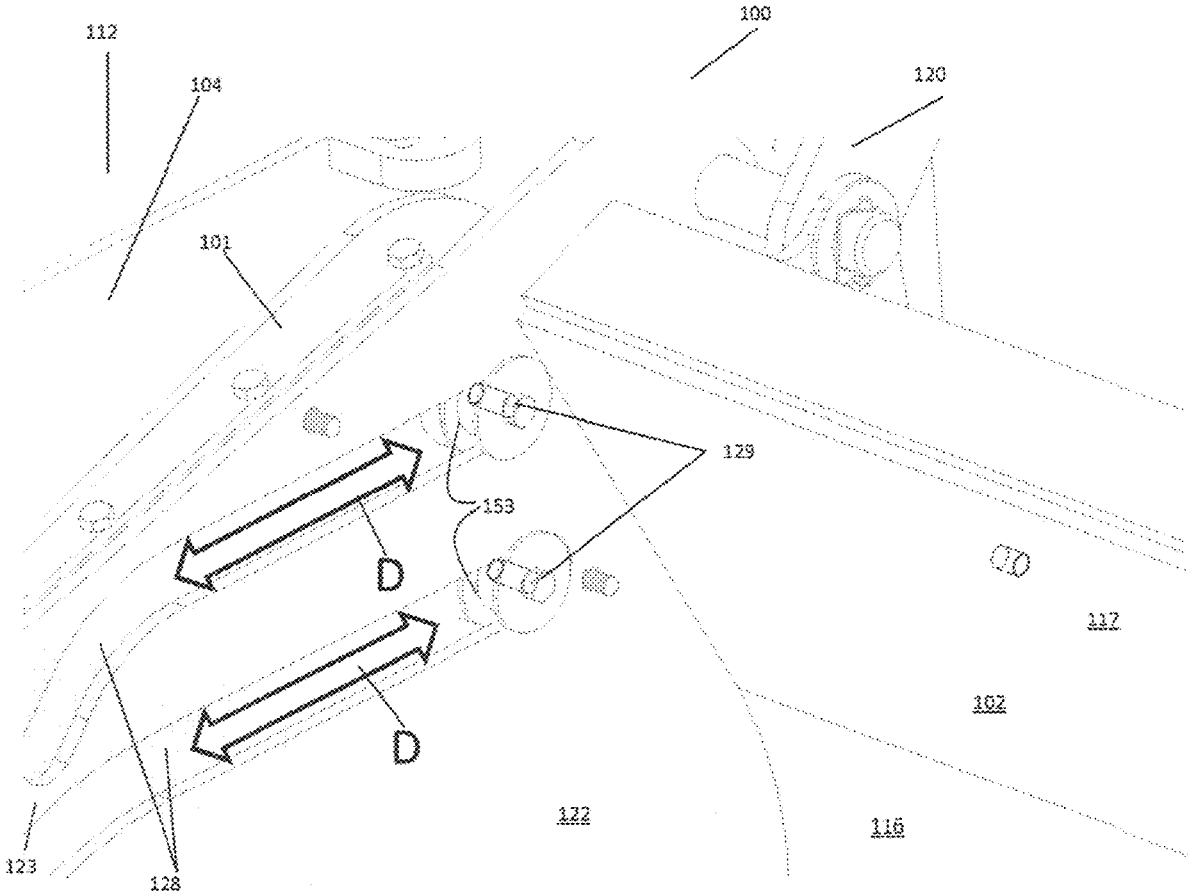

FIG. 14 illustrates a perspective, closeup view of apportion of the left bucket side in one embodiment of the present invention, depicting the direction of lateral movement (D) by the plurality of secured horizontally sliding pins within the plurality of substantially horizontal sliding slots of the opposing bucket back half.

FIG. 15 illustrates a prospective view of an embodiment of the present invention depicting the material handling bucket and loader with a direction of travel arrow, and having the bucket front half extending forward of the opposing bucket back half for scooping application material to the opposing bucket back half.

Figure 16:
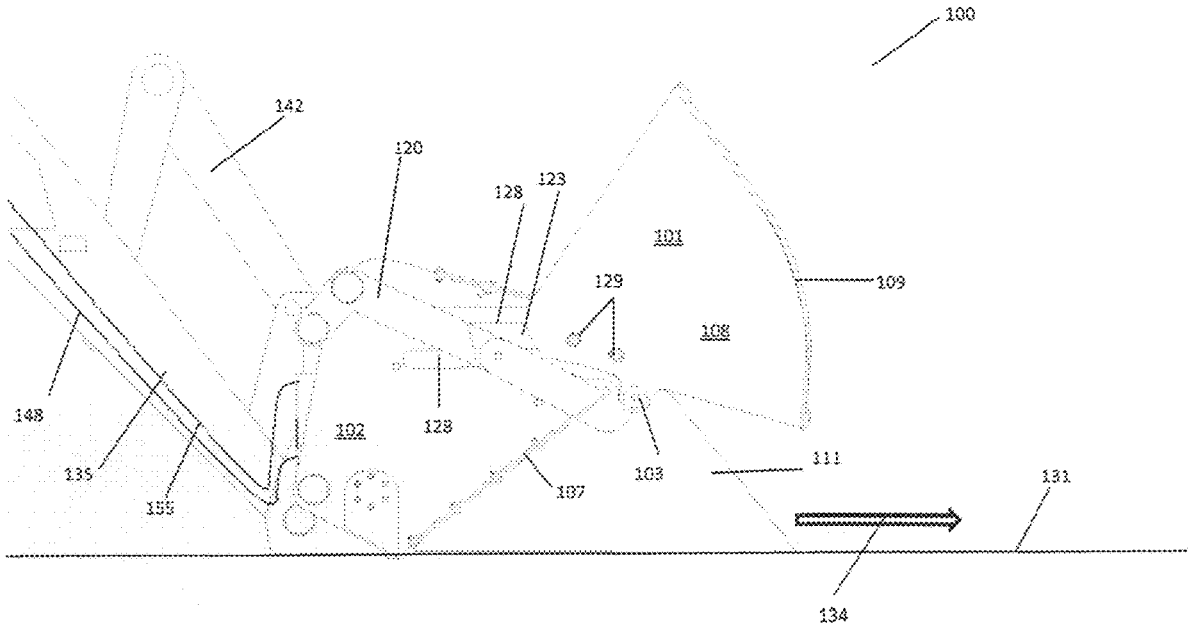

FIG. 16 illustrates an elevation view of a portion of an embodiment of the present invention depicting the bucket left side of the material handling bucket and loader with a direction of travel arrow, and having the bucket front half extending forward of the opposing bucket back half for scooping application material to the opposing bucket back half.

Figure 17:
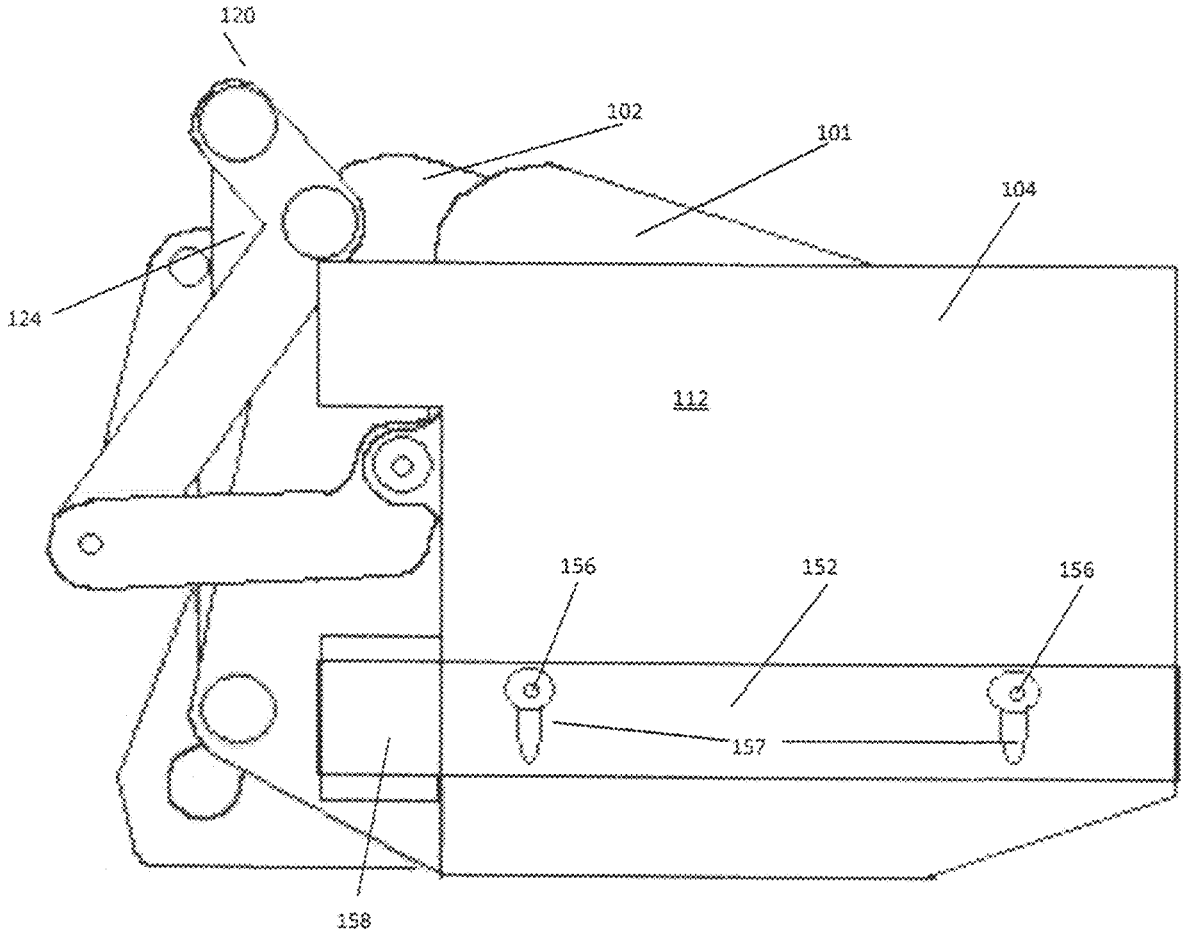

FIG. 17 illustrates an elevation view of a portion of an embodiment of the present invention depicting the bucket left side of the material handling bucket and one of the pair of side gates showing one of a pair of side gate height adjusters.

FIG. 18 illustrates a prospective view of an embodiment of the present invention depicting a material handling bucket and loader having a boom.

DETAILED DESCRIPTION OF THE INVENTION

The present invention will now be described more fully hereinafter with references to the accompanying drawings, in which the preferred embodiment of the invention is shown. This invention, however, may be embodied in different forms, and should not be construed as limited to the embodiments set forth herein. Rather, the illustrative embodiments are provided so that this disclosure will be thorough and complete, and will fully convey the scope of the invention to those skilled in the art. It should be noted, and will be appreciated, that numerous variations may be made within the scope of this invention without departing from the principle of this invention and without sacrificing its chief advantages. Like numbers refer to like elements throughout. A representative number of certain repeated elements are labeled in the drawings.

Figure 1:
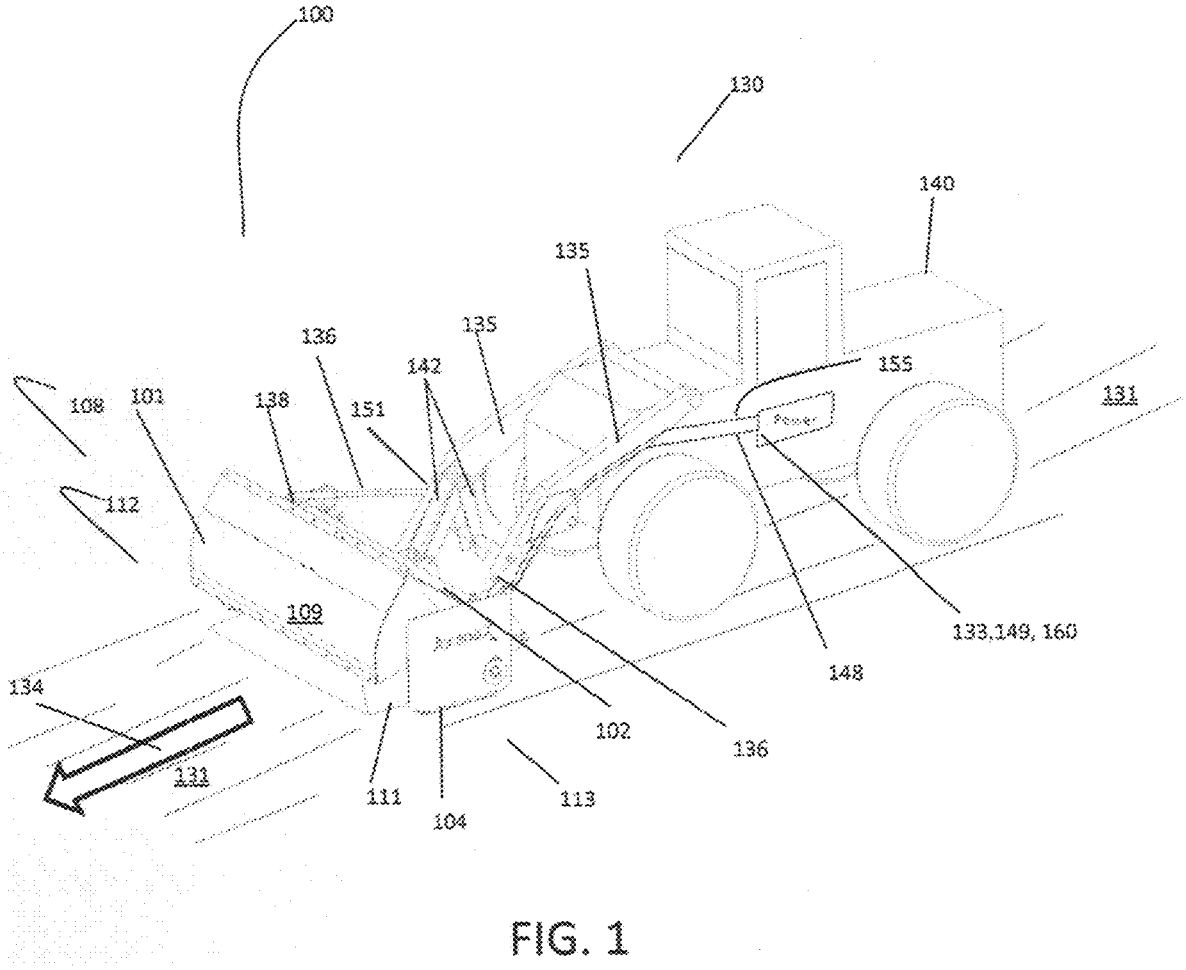
FIG. 1 illustrates a prospective view of an embodiment of the present invention depicting a bucket right side view of the material handling bucket and loader, with a direction of travel arrow.

Turning now in detail to the drawings in accordance with the present invention, FIGS. 1 and 15 depict one embodiment of the present invention, a material handling bucket apparatus, comprising a material handling bucket 100 having a bucket front half 101 and an opposing bucket back half 102, and a left bucket side 112 and an opposing right bucket side 113. FIG. 1 illustrates a prospective view depicting a view of the opposing right bucket side 113 of the material handling bucket 100 and a loader 130, with an arrow indicating travel direction 134. The bucket front half 101 is termed a "clam", or clam shell section, the front section of a loader tractor or earthmover in the construction industry; the opposing bucket back half 102 is termed a "dozer", or a dozer section, the rear section of the loader tractor or earthmover in that industry. The bucket front half 101, depicted in FIGS. 1, 2, 6, 7, and 13, comprises a pair of front pivotally connecting points 103 (FIGS. 6, 7, 13), a convexing front clam surface 109 (FIGS. 1, 2, 6, 7), a left clam side 108 (FIGS. 1, 2, 6, 7), an opposing right clam side 110 (FIGS. 6, 7), a lower edge 115 (FIGS. 2, 3, 8, and 9), and a left clam inside 122 and an opposing right clam inside 132 (FIGS. 6 and 7). As shown in FIGS. 6 and 7, the bucket front half 101 may be otherwise characterized and described as a set of pivoting wedges, and generally u-shaped sections, the left clam side 108 and opposing right clam side 110, having rigidly secured at their circumferential edges a convexing arch surface, a convexing clam front surface 109. As shown in FIGS. 1-3, 8, and 9, the opposing bucket back half 102 (FIGS. 1, 2, 3, 8, 9) comprises a back half left panel 118 (FIGS. 8, 9) and an opposing back half right panel 119 (FIGS. 8, 9) rigidly attaching to a dozer surface panel 114 (FIGS. 8, 9), the dozer surface panel 114 (FIGS. 8, 9) having a dozer bottom 116 (FIGS. 8, 9), an adjacent dozer back 117 (FIG. 8), and a dozer scraping lip 107 (FIGS. 2, 3, 8) running lengthwise (along the front of the opposing bucket back half 102 as depicted) along the dozer bottom 116 (FIG. 8). The dozer scraping lip 107 utilizes a sharp blade for its lip as the cutting edge. The dozer surface panel 114, the back half left panel 118, and the opposing back half right panel 119 are configured and arranged to carry, hold and haul application material 111 and together, they define an open top/front side 139 to the opposing bucket back half 102. The material handling apparatus further comprises a horizontally sliding mechanism 123 securedly, integratingly and cooperatively adjoining the bucket front half 101 with the opposing bucket back half 102 allowing the bucket front half 101 to slide horizontally and cooperatively with respect to the opposing bucket back half 102, depicted in FIGS. 3-9, 11 and 13-14. The horizontally sliding mechanism 123 (shown in FIG. 14) allows the bucket front half 101 to pivot and to advance forward, backward, upward and downward with respect to the opposing bucket back half 102.

The application material 111, depicted in FIGS. 1, 15, and 18, may be at least one of earth, asphalt, concrete, snow, aggregate, dirt, mulch or other landscaping material. Other application materials 111 necessary for hauling by an earthmover, loader tractor, or backhoe may be included, as well. The "handling" function of the material handling bucket 100 is understood herein to include handling, digging, scraping, scooping, gathering, dumping, and/or loading the application material 111. The material handling bucket 100 may handle variable volumes of application material 111.

In an alternative embodiment of the present invention, the horizontally sliding mechanism 123, depicted in FIGS. 3-9, 11 and 13-14, comprises a plurality of secured horizontally sliding pins 129 located within the bucket front half 101, each of the plurality of secured horizontally sliding pins 129 attaching permanently to the left clam inside 122 (FIG. 6) and the opposing right clam inside 132 (FIG. 7), respectively of the bucket front half 101. A plurality of substantially horizontal sliding slots 128 are located through the back half left panel 118 (FIGS. 8, 9, and 11) and the opposing back half right panel 119 to the opposing bucket back half 102, as further described below. Each of the plurality of secured horizontally sliding pins 129 are located and engaged, respectively, cooperatively within one of the plurality of substantially horizontal sliding slots 128 through the opposing bucket back half 102. In this manner, the plurality of secured horizontally sliding pins 129 are slidingly located within and freely and cooperatively engaging the plurality of substantially horizontal sliding slots 128. The plurality of substantially horizontal sliding slots 128 allow and provide horizontal and pivotal movement of the plurality of secured horizontally sliding pins 129 within the plurality of substantially horizontal sliding slots 128, thereby allowing the bucket front half 101 to pivot and to advance forward, backward, upward and downward with respect to the opposing bucket back half 102.

The pair of front connecting pins 103*a* are located at the pair of front pivotally connecting points 103, depicted in FIGS. 12, and 13, and in alternative embodiments of the present invention comprise a plurality of securing pins and bearings 154. The pair of front connecting pins 103*a* pivotally secure a pair of linkage systems 120 to the bucket front half 101.

The opposing bucket back half 102, shown in FIGS. 1-3, 8, and 9, further comprises the plurality of substantially horizontal sliding slots 128 (FIGS. 3, 8, 9), or guiding or guided slots, reference above, which extend through the back half left panel 118 and the opposing back half right panel 119 (FIGS. 8 and 9) to the opposing bucket back half 102, as well as a plurality of loader attaching holes 106 (FIG. 9), and a plurality of loader attachment means 105 (FIGS. 2, 3), also depicted along with the opposing bucket back half 102 in FIGS. 5, and 10-12. The opposing bucket back half 102 is located, and sets immediately, snugly, cooperatively, freely and pivotally within the bucket front half 101.

In alternative embodiments of the present invention, the plurality of loader attachment means 105, depicted in FIGS. 2, 3, 5, and 10-12, comprise at least one of: pins and lugs 159, quick hitches, or hydraulic pins; as means for securely and operationally attaching one element of the material handling apparatus to another element and found in alternative embodiments of the present invention.

In alternative embodiments of the present invention, the plurality of secured horizontally sliding pins 129 comprise a plurality of pin bearings 153 (FIG. 14) allowing for easy horizontal movement of the plurality of secured horizontally sliding pins 129 within the plurality of substantially horizontal sliding slots 128.

The material handling bucket apparatus of the present invention further comprises a loader 130, shown particularly in FIGS. 1, 5, and 15, or as commonly known in the industry, an earthmover or a front end loader, and having a loader tractor 140 (FIGS. 1, 5, 15), a pair of loader operating lifting arms 135 (FIGS. 1, 5, 15), a pair of loader operating tilt arms 142 (FIGS. 1, 15), a hydraulic power unit 149 (FIG. 1), a pair of loader attaching points 137 (FIG. 5), a pair of tilt attaching points 143 (FIG. 15), and a power source 133 (FIG. 1). The principles of the present disclosure of these embodiments may be implemented using any number of loading techniques, such as using a backhoe rather than a front end loader. Shown in FIGS. 2, 3, 5, and 10-12, the plurality of loader attachment means 105 securely and operationally attach the pair of loader operating lifting arms 135 (FIGS. 2, 3, 5, 10, 12) to the opposing bucket back half 102 through the plurality of loader attaching holes 106, as shown in FIG. 9, at the pair of loader attaching points 137 (FIGS. 3, 10, 12), respectively. As well, and shown in FIGS. 2 and 4, the plurality of loader attachment means 105 securely and operationally attach the pair of loader operating tilt arms 142 to the opposing bucket back half 102 through the plurality of loader attaching holes 106 at the pair of tilt attaching points 143, respectively. Each of the pair of loader operating lifting arms 135 to the loader 130 are located proximally on the left bucket side 112 and the opposing right bucket side 113, respectively, and attach to and operating the opposing bucket back half 102 of the material handling bucket 100 by the plurality of loader attachment means 105. The pair of loader operating tilt arms 142 are located between the pair of loader operating lifting arms 135 and attach to and operate the opposing bucket back half 102 by the plurality of loader attachment means 105.

The power source 133 in alternative embodiments of the present invention, as well as in the present invention, (FIGS. 1 and 18) may comprise at least one of: electrical, gas, or hydraulic power. The loader tractor 140 to the loader 130 provides power from the power source 133 to the pair of loader operating tilt arms 142 and the loader operating lifting arms 135, respectively, each through one or more of a plurality of power lines 155.

The loader 130, shown in FIG. 1, or front end loader, earthmover or other similar front end loading equipment known and understood to be broadly conventional in the construction and application material 111 hauling industries, is commonly used, and has and employs a commonly used and readily identifiable power source 133 and a hydraulic power unit 149, as understood to be including in the present invention. Such loaders known in the industry include, but are limited to: front end loaders, back hoes, and smaller skid loaders. The loader power source 133 and hydraulic power unit 149, or propulsion sources, referenced here are standard combustion or electrical and/or hydraulic engines and units, respectively, well known and found in industry. The power source 133 as is commonly found in the industry includes a control means 160, including a control circuit and controls, as a means for operating the loader 130, as well as the other elements comprising the loader 130, and found in alternative embodiments of the present invention (a loader tractor 140, a pair of loader operating lifting arms 135, a pair of loader operating tilt arms 142, a hydraulic power unit 149, and a pair of loader attaching points 137 and a pair of tilt attaching points 143 (or boom 235 shown in FIG. 18), as well as the pair of linkage systems 120 having a pair of front bucket actuating cylinders 124 referenced below (shown in FIG. 13)). The power source 133 in the loader 130 generates and provides power to power and move the loader tractor 140, to move the pair of loader operating tilt arms 142 and the pair of loader operating lifting arms 135, and to operate the hydraulic power unit 149, thereby causing the material handling bucket 100 to operate. The box labeled "Power" shown in FIGS. 1, 15 and 18 depicts, generally, the power source 133, the control means 160 and the hydraulic power unit 149 for the loader 130. The numbered lines leading generally from the box labeled "Power" (for the power source 133, hydraulic power unit 149 and control means 160) and to the material handling bucket 100 are, respectively, the pair of hydraulic lines 148 and the plurality of power lines 155, which figures are understood to generally depict those respective pair and plurality of lines.

As is well known in the industry, the control means 160, such as controls via a control circuit included in the power source 133, operate in a well known manner with the hydraulic power unit 149 to direct hydraulic fluid under pressure from the hydraulic cylinder for extension and contraction of the pair of front bucket actuating cylinders 124, or rams, providing selective extension and retraction of the pair of front bucket actuating cylinders 124, as produced by manipulation of the controls in a conventionally known control means 160.

The material handling bucket apparatus of the present invention further comprises the pair of linkage systems 120, shown in FIGS. 2-4, and 11, and particularly in FIG. 13, and which are pivotally and cooperatively joined to the bucket front half 101, respectively, by a pair of front connecting pins 103*a* (FIGS. 11, 13) located at the pair of front pivotally connecting points 103 (FIGS. 11, 13), the pair of linkage systems 120 comprising the pair of front bucket actuating cylinders 124. In alternative embodiments of the present invention, depicted in FIGS. 2 and 18, and particularly in FIG. 13, the pair of linkage systems 120 comprise a pair of front linkage arms 121; a pair of central linkage arms 125, a pair of rear linkage arms 126, a plurality of linkage lugs 127, a pair of front bucket actuating cylinders 124, and a pair of hydraulic lines 148. The pair of front bucket actuating cylinders 124 are hydraulic cylinders, or rams, commonly known and used in the industry, as referenced above. The pair of front linkage arms 121 are cooperatively and pivotally connected, respectively, to the bucket front half 101 by the pair of front connecting pins 103*a* located at the pair of front pivotally connecting points 103. The pair of central linkage arms 125, in turn, are further cooperatively and pivotally connected, respectively, to the pair of rear linkage arms 126 at a pair of central linkage points 146 by the plurality of linkage lugs 127. The pair of rear linkage arms 126, in turn are further cooperatively and pivotally connected, respectively, to the pair of front bucket actuating cylinders 124 at a pair of cylinder linkage points 147 by the plurality of linkage lugs 127. The hydraulic power unit 149 in the loader tractor 140, shown in FIGS. 1, 13 and 15, provides hydraulic power through the pair of hydraulic power lines 148 to the pair of front bucket actuating cylinders 124, shown in FIG. 13, as described above, to operate the pair of linkage systems 120 thereby operating the bucket front half 101.

In an alternative embodiment of the present invention, as depicted in FIG. 13, the pair of front bucket actuating cylinders 124, operates the pair of linkage systems 120 causing the pair of front linkage arms 121, the pair of central linkage arms 125, and the pair of rear linkage arms 126 (as described above) to connectively and cooperatively, pivotally operate the front bucket half 101.

In the present invention, the bucket front half 101 operates and moves in a pivoting manner around the pair of front pivotally connecting points 103, pivoting over and forward of the open top/front side 139 of the opposing bucket back half 102, resulting in the upward and downward manner and positions shown in FIGS. 11 and 10, respectively.

In alternative embodiments of the present invention, the opposing bucket back half 102 further comprises a plurality of access slots 150 facilitating the connection of the pair of the hydraulic lines 148 to the pair of front bucket actuating cylinders 124, as shown in FIGS. 9-13.

The pair of linkage systems 120, in an embodiment of the present invention, as shown in FIGS. 10, 11, and 13, operate, drive, and laterally move the bucket front half 101 forward beyond the dozer scraping lip 107 of the opposing bucket back half 102 allowing the convexing clam front surface 109 to engage, scoop and haul the application material 111 backward, as shown particularly in FIGS. 12 and 14, onto the dozer surface panel 114 of the opposing bucket back half 102. The loader 130 operating the opposing bucket back half 102 cooperatively through the pair of loader operating tilt arms 142 (as shown in FIGS. 1-3, 5, 15, and 16) tips the opposing bucket back half 102 up and down to load and dump application material 111, and through the pair of loader operating lifting arms 135, lifts, pivots, pushes, and pulls the opposing bucket back half 102 forward, backward, upward and downward. The power source 133 in the loader 130 generates and provides power to move the loader tractor 140, to move the pair of loader operating tilt arms 142 and the pair of loader operating lifting arms 135, and to operate the hydraulic power unit 149, causing the material handling bucket 100 to operate.

In the present invention of the material handling bucket apparatus, the ground surface 131, over which the loader 130 (having the material handling apparatus 100) traverses in the travel direction 134 (as depicted in FIGS. 1, 15, and 18) contains on, or has as, its surface the application material 111. In alternative embodiments of the present invention, the application material 111 comprises at least one of: earth, asphalt, concrete, snow, aggregate, dirt, mulch or other landscaping material.

The loader 130 moving along the ground surface 131 in the travel direction 134 allows and causes the dozer scraping lip 107 to advance on the ground surface 131 scraping up and gathering the application material 111 onto the dozer surface panel 114, shown in FIGS. 1, 8, 9 and 15, and pivots the opposing bucket back half 102 to haul the application material 111, which is carried on the dozer surface panel 114.

Alternative embodiments of the present invention (shown in FIGS. 1, 2, 15, and 18 and particularly in FIGS. 17 and 18) include a pair of side gates 104 located and freely attached, respectively, to the left bucket side 112 and the opposing right bucket side 113 of the opposing bucket back half 102. In another alternative embodiment, the pair of side gates 104 are freely attached to the left bucket side 112 and the opposing right bucket side 113 by a pair of side gate adjuster bars 152. The pair of side gate adjuster bars 152 are integrally and partially attached to the left bucket side 112 and the opposing right bucket side 113 of the opposing bucket back half 102, respectively, at a pair of bar attachment portions 158, allowing the pair of side gates 104 to slide between the opposing bucket back half 102 and the pair of side gate adjuster bars 152. Each of the pair of side gate adjuster bars 152 have a plurality of substantially vertical sliding slots 157. A plurality of secured vertical sliding pins 156 are permanently fixed to the left bucket side 112 and the opposing right bucket side 113, respectively of the opposing bucket back half 102 and are located and engaged, cooperatively within one of the plurality of substantially vertical sliding slots 157 through one of the respective pair of side gate adjuster bars 152. The plurality of secured vertical sliding pins 156 allow the pair of side gates 104 to slide, adjust and move vertically between the opposing bucket back half 102 and the pair of bar attachment portions 158. A pair of stabilizer bars 136 each have, respectively, one of a pair of stabilizer attaching ends 151 and one of a pair of opposing gate attaching ends 138 and each of the pair of stabilizer bars 136 cooperatively and operatively attach to the loader tractor 140 by the plurality of loader attachment means 105 at the pair of stabilizer attaching ends 151, respectively, and cooperatively, operatively secure to each of the pair of side gates 104 at the pair of opposing gate attaching ends 138, respectively. The pair of stabilizer bars 136 freely support, stabilize and operate the pair of side gates 104 independent of the bucket front half 101 and the opposing bucket back half 102. In this manner, the pair of side gates 104 orient horizontally in proximity to the ground surface 131, and the pair of side gates 104 restrict movement of the application material 111 within the opposing bucket back half 102. The pair of side gates 104, as set forth, can restrict movement of the application material 111 within the opposing bucket back half 102, preventing spillage and loss of the application material 111 in transit along the travel direction 134 (depicted in FIG. 1). The power to operate the pair of stabilizer bars 136 is provided through the plurality of power lines 155 by the control means 160.

The elements of the material handling bucket apparatus, depicted in FIGS. 1-18, including the bucket front half 101 the opposing bucket back half 102, the pair of side gates 104 (FIGS. 1 and 17) and the pair of linkage systems 120 (FIGS. 2, 13); are made of sturdy and resilient metal, such as steel, commonly found in the loader and application material 111 haulage industries.

In an alternative embodiment of the present invention, the material handling bucket apparatus, shown in FIG. 18, comprises a loader 130 having a loader tractor 140, a boom 235, a hydraulic power unit 149, and a power source 133, and a material handling bucket 100 having a bucket front half 101 and an opposing bucket back half 102, a left bucket side 112 and an opposing right bucket side 113. The bucket front half 101 comprises a pair of front pivotally connecting points 103 (FIGS. 6, 7, and 13), a convexing clam front surface 109 (FIGS. 1, 2, 6, and 7), a left clam side 108 (FIGS. 1, 2, 6, and 7) and an opposing right clam side 110 (FIGS. 6 and 7), a lower edge 115 (FIGS. 2, 6, and 7) and a left clam inside 122 and an opposing right clam inside 132. The opposing bucket back half 102 comprises a back half left panel 118 (FIGS. 8 and 9) and an opposing back half right panel 119 rigidly attaching to a dozer surface panel 114 (FIGS. 8 and 9), the dozer surface panel 114 (FIGS. 8 and 9) having a dozer bottom 116 (FIG. 8), an adjacent dozer back 117 (FIG. 8), and a dozer scraping lip 107 (FIGS. 2, 3, and 8) running lengthwise along the dozer bottom 116, as are shown in FIGS. 2, 3, 8, and 9. The dozer surface panel 114, the back half left panel 118, and the opposing back half right panel 119, define an open top/front side 139 to the opposing bucket back half 102. The material handling apparatus further comprises a horizontally sliding mechanism 123 securedly, integratingly and cooperatively adjoining the bucket front half 101 with the opposing bucket back half 102 allowing the bucket front half 101 to slide horizontally and cooperatively with respect to the opposing bucket back half 102 (as depicted in FIGS. 3-9, 11 and 13-14). A pair of linkage systems 120 are pivotally and cooperatively joined to the bucket front half 101, respectively, at the pair of front pivotally connecting points 103 by a pair of front connecting pins 103*a* (FIGS. 12 and 13). The opposing bucket back half 102 further comprises a plurality of loader attaching holes 106, and a plurality of loader attachment means 105 (shown in FIGS. 3, 8 and 9). The opposing bucket back half 102 is located immediately, snugly, cooperatively, freely, and pivotally within the bucket front half 101. The pair of linkage systems 120 are pivotally and cooperatively joined to the bucket front half 101, respectively by the pair of front pivotally connecting points 103. The bucket front half 101 operates and moves in a pivoting manner around the pair of front pivotally connecting points 103, pivoting over and forward of the open top/front side 139 of the opposing bucket back half 102. The horizontally sliding mechanism 123 (shown in FIG. 14) allows the bucket front half 101 to pivot and to advance forward, backward, upward and downward with respect to the opposing bucket back half 102.

This alternative embodiment, depicted in FIG. 18, further comprises the loader tractor 140 to the loader 130 providing power from the power source 133 to the boom 235, a pair of stabilizer bars 136 and the hydraulic power unit 149 through a plurality of power lines 155. The hydraulic power unit 149 in the loader tractor 140 provides hydraulic power through a pair of hydraulic power lines 148 to the pair of front bucket actuating cylinders 124 thereby operating the pair of linkage systems 120. The pair of linkage systems 120 operates, drives and laterally moves the bucket front half 101 forward beyond the dozer scraping lip 107 of the opposing bucket back half 102 allowing the convexing clam front surface 109 to engage, scoop and haul application material 111 from a ground surface 131 backward onto the dozer surface panel 114 (shown in FIGS. 8 and 9) of the opposing bucket back half 102. The boom 235, depicted in FIG. 18, is operationally and attachedly located between the loader tractor 140 and the opposing bucket back half 102, and attaches to and operates the opposing bucket back half 102.

This alternative embodiment further comprises the ground surface 131 having the application material 111, as shown in FIGS. 1 and 18. The loader 130 operates the opposing bucket back half 102 cooperatively through the boom 235, tipping the opposing bucket back half 102 up and down to dump the application material 111, and through the pair of loader operating lifting arms 135 to lift, pivot, push and pull the opposing bucket back half 102 forward, backward, upward and downward. The loader 130 moves along the ground surface 131 in a travel direction 134 allowing the dozer scraping lip 107 to advance on the ground surface 131, scraping up and gathering application material 111 onto the dozer surface panel 114, and pivoting the opposing bucket back half 102 to haul the application material 111, which is carried on the dozer surface panel 114. The power source 133 in the loader 130 generates and provides power to power and move the loader tractor 140, to move the boom 235, and to operate the hydraulic power unit 149, causing the material handling bucket 100 to operate.

Another alternative embodiment of the material handling bucket apparatus comprises the boom 235, as shown in FIG. 18, having a pair of loader operating lifting arms 135, a pair of loader operating tilt arms 142, a pair of loader attaching points 137, and a pair of tilt attaching points 143. The plurality of loader attachment means 105, shown in FIGS. 2, 3, 5, 10 and 11, securely and operationally attach the pair of loader operating lifting arms 135 to the opposing bucket back half 102 through the plurality of loader attaching holes 106 at the pair of loader attaching points 137, respectively. The plurality of loader attachment means 105 securely and operationally attach the pair of loader operating tilt arms 142 to the opposing bucket back half 102 through the plurality of loader attaching holes 106 at the pair of tilt attaching points 143, respectively. The pair of loader operating lifting arms 135 are each located proximally to the left bucket side 112 and the opposing right bucket side 113, respectively, and attaching to and operating the opposing bucket back half 102 of the material handling bucket 100 by the plurality of loader attachment means 105. The pair of loader operating tilt arms 142 is located between the pair of loader operating lifting arms 135 and attaches to and operates the opposing bucket back half 102 by the plurality of loader attachment means 105. The loader 130 operates the opposing bucket back half 102 cooperatively through the pair of loader operating tilt arms 142 of the boom 235, tipping the opposing bucket back half 102 up and down to dump the application material 111, and through the pair of loader operating lifting arms 135 to the boom 235, lifting, pivoting, pushing and pulling the opposing bucket back half 102 forward, backward, upward and downward.

The present invention, shown in FIGS. 1-18, provides the loader 130, or an earthmover or other similar front end loading equipment known in the industry, as noted above, and having the pair of linkage systems 120 on the sides of the material handling bucket 100, the left bucket side 112 and the opposing right bucket side 113. Current related art provides clamshell buckets that only pivot on a singular axis, in order to open and close. The pair of linkage systems 120 to the present invention, located on each of the pair of bucket sides, the left bucket side 112 and the opposing right bucket side 113 of the opposing bucket back half 102, enable the bucket front half 101, or clam portion, to travel forward, in the travel direction 134 of the loader 130, independent of the opposing bucket back half 102, in a lateral direction parallel to the ground surface 131, while at the same time leaving the opposing bucket back half 102 tilted back and in a position to be loaded. FIG. 2 illustrates an elevational view of the left bucket side 112 of a portion of the loader 130 and of the bucket front half 101 pivoted downward to the ground surface 131, while FIG. 3 illustrates an elevational view of the left bucket side 112 of a portion of the loader 130 and the bucket front half 101 pivoting upward. Direction of pivotal movement (A) is shown for the bucket front half 101 around one of the plurality of linkage lugs 127.

The present invention as shown in FIGS. 1-18 is a "double action bucket" where the material handling bucket 100 slides by the plurality of secured horizontally sliding pins 129 attached to the bucket front half 101 sliding or moving within the plurality of substantial horizontal sliding slots 128 within the opposing bucket back half 102, the bucket front half 101 sliding and moving forward; and then pivoting upward to open with respect to the opposing bucket back half 102 on an axis at the plurality of linkage lugs 127, and subsequently reversing or pivoting downward to close against the opposing bucket back half 102. FIG. 14 illustrates a perspective, closeup view of a portion of the left bucket side 112, depicting the direction of lateral movement (D) by the plurality of secured horizontally sliding pins 129 within the plurality of substantially horizontal sliding slots 128. This horizontal sliding action provides the material handling bucket 100 with the capability, and the operator of the loader 130 with the ability of using the opposing bucket back half 102, to doze the application material 111 in the travel direction 134, while having the clam, the bucket front half 101, open or upward, and then to slide the bucket front half 101 forward in the travel direction 134, to further scoop or gather more application material 111, gathering a much higher volume of a load of application material 111 than in the currently used versions in the applicable industries. The clam, the bucket front half 101, can then be closed pivoting downward against the opposing bucket back half 102 to contain the application material 111 once it is loaded. FIGS. 12 and 13 illustrate a perspective view of a portion of the left bucket side 112 of the material handling bucket apparatus in one embodiment of the present invention, depicting the material handling bucket 100 and the attaching pair of linkage systems 120, showing the bucket front half 101 pivoted downward around the opposing bucket back half 102 and to the ground surface 131. Directions of vertical movement (B) and lateral or horizontal movement (C) are shown for the opposing bucket back half 102.

FIG. 13 illustrates a perspective view of the left bucket side 112 of the pair of linkage systems 120 to the material handling bucket apparatus of a portion of one embodiment of the present invention. The pair of linkage systems 120 enable the bucket front half 101, or clam portion, to travel forward, in the travel direction 134, independent of the opposing bucket back half 102, or bucket portion, in the travel direction 134 parallel to the ground surface 131, while at the same time leaving and allowing the opposing bucket back half 102 to remain tilted back, toward the loader 130 in a position to be loaded, as particularly shown in FIG. 3. When the material handling bucket 100 is open, as described above, the portion of the material handling bucket 100 that is in contact with the ground surface 131 is the dozer portion, the opposing bucket back half 102 in the present invention. FIG. 3, again, illustrates the bucket front half 101, as well as the opposing bucket back half 102, pivoting upward. The material handling bucket 100 (again, the overall material handling unit of the present invention) is in a tilt back, or upward, position, as shown in FIG. 3, as far as the hydraulic cylinders, the pair of front bucket actuating cylinders 124, will allow. When the material handling bucket 100 is fully closed, it is characterized in industry as a loader bucket in the tilted back position, for hauling application material 111. In order to operate the material handling bucket 100 as a dozer, an operator has to roll the material handling bucket apparatus of the present invention forward, placing the opposing bucket back half 102 into a position level with the ground surface 131, as shown in FIGS. 1, 15, and 18.

The unique independent linkage and track mechanisms for the pair of linkage systems 120 (particularly in FIG. 13) and elements of the loader 130, shown in FIGS. 2, 10-12, and 15, in an alternative embodiment of the present invention, allow for easy loading of the application material 111 without an operator having to simultaneously tilt the opposing bucket back half 102 and retract the bucket front half 101. These unique and independent mechanisms include: (I) the ability of the pair of linkage systems 120 to cause the bucket front half 101 to pivot upward and downward around the pair of front pivotally connecting points 103, while (ii) independently allowing the pair of loader operating lifting arms 135 and the pair of loading tilt arms 142 to cause the opposing bucket back half 102 to move upward and downward (tilt), and forward and backward (roll). The material handling bucket 100, also, allows the opposing bucket back half 102 to be in the tilted back loaded position, as shown in FIG. 3. while loading the application material 111, as generally shown in FIGS. 3, 5, 11, and 15.

With the extended reach offered by the pair of linkage systems 120, shown in detail and operation in FIGS. 13-15, to the present invention, the material handling bucket apparatus, can be easily and fully loaded with application material 111 by a single control input at the control means 160 by the operator. Because it is already tilted back in the loaded position, the opposing bucket back half 102 can be full loaded with application material 111 scooped up by the bucket front half 101 without the application material 111 spilling out the front of material handling bucket 100. The optional material containment gates, the pair of side gates 104, shown in FIGS. 1, 15, and 18, allow application material 111 to be gathered in front of the dozer scraping lip 107 and dozer surface panel 114 of the opposing bucket back half 102 (the dozer portion of the material handling bucket 100) without the application material 111 spilling outside the edges, or reach, of the dozer scraping lip 107. The loader 130 can travel in the travel direction 134 against and parallel to the ground surface 131 cleanly loading the application material 111. Once an adequate amount of the application material 111 has been gathered by the material handling bucket 100, the bucket front half 101, or clam portion, can be closed with one simple control input from the control means 160. The bucket front half 101 will lower or pivot closing against the opposing bucket back half 102. The material handling bucket 100 can operate independent of the pair of side gates 104, keeping the pair of side gates 104 out of the way of the material handling bucket 100 for easy unloading of the application material 111 into trucks, and for operation of the material handling bucket 100 in a traditional loader bucket manner.

The embodiments of the present invention as material bucket handling apparatuses, depicted overall in FIGS. 1, 4, 15 and 18 (having multipurpose uses in the construction industry, the application material 111 hauling industries and related industries and uses) by having the pair of linkage systems 120 uniquely allow for ease of use, and by having the pair of side gates 104 uniquely allow for neater and more controllable loading of the application material 111. The pair of linkage systems 120 interact during operation of the material handling apparatus of the present invention, as described above, with the pair of substantially horizontally slots 128 provided in the sides of the opposing bucket back half 102. As shown in FIGS. 12 and 13, the bucket front half 101, or clam, which is secured to the pair of linkage systems 120 of the material handling bucket 100 by a pair of front connecting pins 103*a* at the pair of front pivotally connecting points 103, and the plurality of secured horizontally sliding pins 129 attached to the left clam inside 122 and the opposing right clam inside 132 of the bucket front half 101 (shown in FIGS. 4 and 14) and that are disposed within the plurality of substantially horizontal slots 128 of the opposing bucket back half 102. The plurality of secured horizontally sliding pins 129 are adapted to permit the bucket front half 101 to slide well forward of the opposing bucket back half 102 and parallel to the ground surface 131, in the travel direction 134 and then pivot upwardly around the pair of front pivotally connecting points 103, or effectively on its axis, into an open position (shown in FIGS. 3 and 11). Once the opposing bucket back half 102 has dozed forward to load application material 111, the bucket front half 101 is then retracted, gathering application material 111 along the ground surface 131 toward the opposing bucket back half 102. The application material 111 is contained within the opposing bucket back half 102 once the bucket front half 101 is fully retracted. The pair of side gates 104, the pair of optional material containment gates in an alternative embodiment, may be attached to the sides of the material handling bucket 100 to prevent loaded application material 111 from spilling out of the material handling bucket 100.

The pair of linkage systems 120 of the present invention, depicted in FIG. 13, extends the reach of the bucket front half 101, or clam, and allows the lower edge 115 (shown in FIGS. 2 and 3) to travel against, or flush with, and parallel to, the ground surface 131, in or opposite to the travel direction 134 (FIG. 1) with one simple control input, leaving the opposing bucket back half 102 tilted back in the loaded position, carrying the application material 111 (FIG. 1). This allows the opposing bucket back half 102 to be fully loaded without spilling the application material 111 out from the dozer scraping lip 107, or front, of the opposing bucket back half 102, as is a common problem with other material bucket handling apparatuses in the industry.

In alternative embodiments of the present invention, the pair of side gates 104, or removable containment gates, shown in FIGS. 1, 15, 17, and 18, run parallel to the ground surface 131, when the bucket front half 101 is up and open and the opposing bucket back half 102 is in a loaded position hauling application material 111 (FIG. 3). The pair of side gates 104, therefore, operate as the application material 111 containing side gates. The material handling bucket 100 can dump the application material 111 while operating independent of the pair of side gates 104, out of the way of the operation of the opposing bucket back half 102. This mechanism also allows the material handling bucket 100 to be operated in a traditional, dozing manner without the pair of side gates 104 interfering with operations.

An alternative embodiment of the present invention is a method for handling application or surface material with a loader 130, the method comprising having a loader 130 which comprises a loader tractor 140, a boom 235, a hydraulic power unit 149, a material handling bucket 100, a pair of linkage systems 120, and a power source 133, as shown generally in FIG. 18, as well as FIGS. 1-16. The power source 133 is operated with a control means 160, which in alternative embodiments provides for controls and a control circuit (FIGS. 1, 15, and 18). The method further comprises providing the material handling bucket 100 with a bucket front half 101 and an opposing bucket back half 102, the bucket front half 101 moving independently of the opposing bucket back half 102, and with a pair of front pivotally connecting points 103, a convexing clam front surface 109, a left clam side 108 and an opposing right clam side 110, and a lower edge 115; and the opposing bucket back half 102 with a dozer bottom 116 and a dozer scraping lip 107 having a sharp scraping edge and running lengthwise along the dozer bottom 116. The method further comprises pivotally and cooperatively joining the pair of linkage systems 120 to the bucket front half 101, respectively at the pair of front pivotally connecting points 103 by a pair of front connecting pins 103*a*. The opposing bucket back half 102 is provided with a plurality of loader attaching holes 106 and a plurality of loader attachment means 105. The method further comprises installing a horizontally sliding mechanism 123, shown in FIGS. 3-5, 11, and 14, securedly, integratingly and cooperatively adjoining the bucket front half 101 with the opposing bucket back half 102 allowing the bucket front half 101 to slide horizontally and cooperatively with respect to the opposing bucket back half 102.

This alternative method embodiment of the present invention immediately above further comprises, as shown in FIGS. 2, 3, and 16, operating and moving the bucket front half 101 in a pivoting manner around the pair of front pivotally connecting points 103, pivoting over and forward of the open top/front side 139 of the opposing bucket back half 102, allowing the bucket front half 101 to pivot and to advance forward, backward, upward and downward with respect to the opposing bucket back half 102 by allowing and providing horizontal and pivotal movement from the horizontally sliding mechanism 123. Hydraulic power from the hydraulic power unit 149 is provided through a pair of hydraulic power lines 148 operating the pair of linkage systems 120, and thereby operating, driving and laterally moving the bucket front half 101 forward beyond the opposing bucket back half 102 with the pair of linkage systems 120, and allowing the convexing clam front surface 109 to engage, scoop and haul application material 111 from a ground surface 131 backward onto the opposing bucket back half 102. The method operationally and attachedly locates the boom 235 between the loader tractor 140 and the opposing bucket back half 102. The boom 235, shown in FIG. 18, is attached to the opposing bucket back half 102 at the plurality of loader attachment means 105 and cooperatively operating the opposing bucket back half 102 with the loader 130, tipping the opposing bucket back half 102 up and down to dump the application material 111. The boom 235 is used to lift, pivot, push and pull the opposing bucket back half 102 forward, backward, upward and downward. The application material comprises at least one of: earth, asphalt, concrete, snow, aggregate, dirt, mulch or other landscaping material.

In an alternative method embodiment of the present invention, the horizontally sliding mechanism 123, depicted in FIGS. 3-9, 11 and 13-14, comprises attaching a plurality of secured horizontally sliding pins 129 within the bucket front half 101, each of the plurality of secured horizontally sliding pins 129 attaching permanently to the left clam inside 122 (FIG. 7) and the opposing right clam inside 132 (FIG. 8), respectively of the bucket front half 101. A plurality of substantially horizontal sliding slots 128 are located through the back half left panel 118 (FIGS. 8, 9, and 11) and the opposing back half right panel 119 to the opposing bucket back half 102. Each of the plurality of secured horizontally sliding pins 129 are located and engaged, respectively, cooperatively within one of the plurality of substantially horizontal sliding slots 128 through the opposing bucket back half 102. In this manner, the plurality of secured horizontally sliding pins 129 are slidingly located within and freely and cooperatively engaging the plurality of substantially horizontal sliding slots 128. The plurality of substantially horizontal sliding slots 128 are allowed and provided with horizontal and pivotal movement of the plurality of secured horizontally sliding pins 129 within the plurality of substantially horizontal sliding slots 128, thereby allowing the bucket front half 101 to pivot and to advance forward, backward, upward and downward with respect to the opposing bucket back half 102.

In this same alternative method embodiment of the present invention, above, the loader 130 is moved along the ground surface 131 in a travel direction 134, shown in FIGS. 1, 16, and 18, allowing the dozer scraping lip 107 to advance on the ground surface 131 scraping up and gathering application material 111 onto the dozer surface panel 114, and pivoting the opposing bucket back half 102 to haul the application material 111 which is carried on the dozer surface panel 114. A pair of side gates 104, respectively, are located and freely attached to the left bucket side 112 and the opposing right bucket side 113 of the opposing bucket back half 102. A pair of stabilizer bars 136 are cooperatively and operatively attached to the loader tractor 140, as shown in FIGS. 1 and 18 by the plurality of loader attachment means 105, respectively, and cooperatively, operatively securing each of the pair of stabilizer bars 136 by the plurality of loader attachment means 105 to each of the pair of side gates 104, respectively, freely supporting, stabilizing and operating the pair of side gates 104 independent of the bucket front half 101 and the opposing bucket back half 102, the pair of side gates 104 orienting horizontally in proximity to the ground surface 131. This method restricts movement of, and neatly contains, the application material 111 within the opposing bucket back half 102 with the pair of side gates 104. Power is generated and provided from the power source 133 in the loader 130 to power and move the loader tractor 140, to move the boom 235, to operate the hydraulic power unit 149, and cause the material handling bucket 100 to operate.

An alternative method embodiment of the present invention provides for handling surface material with a loader of where the pair of linkage systems, shown in FIGS. 2, 13, and 16, comprises a pair of front linkage arms 121; a pair of central linkage arms 125, a pair of rear linkage arms 126, a plurality of linkage lugs 127, a pair of front bucket actuating cylinders 124, and a pair of hydraulic lines 148. This method cooperatively and pivotally connects the pair of front linkage arms 121, respectively, to the bucket front half 101 by a pair of front connecting pins 103*a* located at the pair of front pivotally connecting points 103; which further cooperatively and pivotally connects, in turn, the pair of central linkage arms 125, respectively, to the pair of rear linkage arms 126 at a pair of central linkage points 146 by the plurality of linkage lugs 127; and in turn, cooperatively and pivotally connects the pair of rear linkage arms 126, respectively, to the pair of front bucket actuating cylinders 124 at a pair of cylinder linkage points 147 by the plurality of linkage lugs 127; providing hydraulic power from the hydraulic power unit 149 in the loader tractor 140 through the pair of hydraulic power lines 148 operating, respectively, the pair of linkage systems 120 and, in turn, operating the pair of front bucket actuating cylinders 124; and, ultimately, operating the pair of linkage systems 120 by the pair of front bucket actuating cylinders 124, causing the pair of front linkage arms 121; the pair of central linkage arms 125, and the pair of rear linkage arms 126 to connectively and cooperatively pivotally operate the front bucket half 101.

Another alternative embodiment of the present invention is a method for handling application or surface material with a loader 130, shown in FIGS. 2-17, and particularly FIG. 18, comprising having the loader 130 comprising a loader tractor 140, a boom 235, a material handling bucket 100, a pair of linkage systems 120, and a power source 133, wherein the power source 133 comprises at least one of: electrical, gas, hydraulic power, or any other power source used in the construction or hauling industry. This method embodiment operates the power source 133 with a control means comprising; a control circuit and controls. The material handling bucket 100 is provided with a bucket front half 101 and an opposing bucket back half 102, and the boom 235 operationally and attachedly located between the loader tractor 140 and the opposing bucket back half 102, which is located snugly, pivotally, and freely moving within the bucket front half 101. The method provides the opposing bucket back half 102 with a dozer bottom 116 and a dozer scraping lip 107. The bucket front half 101 is operatively connected to the loader 130 by the pair of linkage systems 120, and the boom 235 is operatively connected to the opposing bucket back half 102.

This method embodiment of the present invention further comprises installing a horizontally sliding mechanism 123 (shown in FIGS. 3-5, 11, and 14) securedly, integratingly and cooperatively adjoining the bucket front half 101 with the opposing bucket back half 102 allowing the bucket front half 101 to slide horizontally and cooperatively with respect to the opposing bucket back half 102. The method operates and moves the bucket front half 101 by the pair of linkage systems 120 in a pivoting and lateral manner, pivoting over and forward of the opposing bucket back half 101, thereby allowing and providing horizontal and pivotal movement by the horizontally sliding mechanism 123 causing the bucket front half 101 to pivot and to advance forward, backward, upward and downward with respect to the opposing bucket back half 102; operating, driving and laterally moving the bucket front half 101 forward beyond the bucket front half 101; and allowing the bucket front half 101 to engage, scoop and haul application material 111 from a ground surface 131 backward onto the opposing bucket back half 102. In this manner, the method comprises operating the opposing bucket back half 102 with the loader 130 cooperatively through the boom 235 and tipping the opposing bucket back half 102 up and down to load and dump the application material 111, while using the boom 235 to lift, pivot, push and pull the opposing bucket back half 102 forward, backward, upward and downward. The loader 130 moves along the ground surface 131 in a travel direction 134 allowing the dozer scraping lip 107 to advance on the ground surface 131 scraping up and gathering application material 111 into the opposing bucket back half 102, and pivoting the opposing bucket back half 102 to haul the application material 111. A pair of side gates 104 are locating and freely attaching, respectively, to the left bucket side 112 and the opposing right bucket side 113 of the opposing bucket back half 102, and a pair of stabilizer bars 136 are cooperatively and operatively attaching to the loader tractor 140, which may be by the plurality of loader attachment means 105 (described above) or other means of cooperative attachment, respectively, and cooperatively, operatively securing each of the pair of stabilizer bars 136 to each of the pair of side gates 104, respectively, and freely supporting, stabilizing and operating the pair of side gates 104 independent of the bucket front half 101 and the opposing bucket back half 102. The pair of side gates 104 are oriented horizontally in proximity to the ground surface 131, and restrict the movement of, and neatly contain, the application material 111 within the opposing bucket back half 102 with the pair of side gates.

The method of this embodiment of the present invention further comprises generating and providing power from the power source 133 in the loader 130 to move the loader tractor 140, and operate the boom 235, to operate the hydraulic power unit 149, and cause the material handling bucket 100 to operate. The pair of linkage systems 120 comprise a pair of front linkage arms 121; a pair of central linkage arms 125, a pair of rear linkage arms 126, a plurality of linkage lugs 127, a pair of front bucket actuating cylinders 124, and a pair of hydraulic lines 148 (FIG. 13). This method cooperatively and pivotally connects the pair of front linkage arms 121, respectively, to the bucket front half 101 by a pair of front connecting pins 103*a* located at the pair of front pivotally connecting points 103 and further cooperatively and pivotally connects, in turn, the pair of central linkage arms 125, respectively, to the pair of rear linkage arms 126 at a pair of central linkage points 146 by the plurality of linkage lugs 127. In turn, the pair of rear linkage arms 126 are further cooperatively and pivotally connected, respectively to the pair of front bucket actuating cylinders 124 at a pair of cylinder linkage points 147 by the plurality of linkage lugs 127. Hydraulic power is provide thereby from the hydraulic power unit 149 (FIGS. 1, 13 and 18) in the loader tractor 140 through the pair of hydraulic power lines 148 to operate the pair of linkage systems 120 by operating the pair of front bucket actuating cylinders 124, causing the pair of front linkage arms 121; the pair of central linkage arms 125, and the pair of rear linkage arms 126 to connectively and cooperatively pivotally operate the front bucket half 101. The application material 111 comprises at least one of: earth, asphalt, concrete, snow, aggregate, dirt, mulch or other landscaping material.

Potential uses and advantages of the present invention include being able to neatly cut seams in the ground surface 131, as shown in FIG. 1, for paving operations without spilling application material 111 onto the finished surface. This advantage greatly reduces labor needed to clean the application material 111 spillage off of finished ground surface 131. The related problem of an operator trying to neatly load application material 111 while having to simultaneously operate multiple controls in the loader 130, without spilling application material 111 from the material handling bucket 100 is solved by the uniquely shaped front bucket half 101, or clam portion of bucket, and the unique "parallel to ground linkage" provided by the pair of linkage systems 120 (FIG. 13) to the bucket front half 101, described above. The reach of the material handling bucket 100 is greatly extended with one control input having the opposing bucket back half 102 tilted back in the loaded position, shown in FIGS. 3 and 11. The problem of application material 111 spillage off the sides of the opposing bucket back half 102, the dozer portion of the material handling bucket 100 is solved by the optional unique containment gates, the pair of side gates 104, described above in alternative embodiments. The problem of side gates (as employed in other known, traditional loader equipment in the industry) being in the way of application material 111 offloading is solved by the unique pair of side gates 104, particularly shown in FIG. 17, independently mounting to the material handling bucket apparatus and to its opposing bucket back half 102, which allows for the material handling bucket 100 to operate inside and independent of the pair of side gates 104.

Another advantage of the present invention is that it will allow for gathering and collecting the application material 111, depicted in FIG. 1, along a roadway shoulder without spilling the application material 111 off of the road shoulder, while greatly reducing equipment and labor needed to clean spilled application material 111.

Another advantage of the present invention is allowing for cleaning by the material handling bucket apparatus in tight areas without spilling the application material 111 in the traveled way along the travel direction 134 shown in FIG. 1. This would make roadway construction areas safer by keeping material handling equipment from having to enter the traffic traveling lane thereby keeping traffic flowing freely with less over all impact on the traveling public from application material 111 gathering and hauling.

Another advantage of the present invention is that the material handling bucket 100, shown FIGS. 1-18, is optimal for snow removal by gathering and effectively containing snow, as the application material 111, and not spilling it into the traffic traveled way or onto sidewalks, etc., as the loader 130 moves in the travel direction 134, as facilitated by the easy loading mechanism and pair of side gates 104.

Another advantage of the present invention is that the material handling bucket apparatus is optimal for maintenance, landscaping, and agriculture applications for the same reasons as outlined immediately above. In essence, the present invention is effective for any task that allows for easily and neatly gathering and loading of a substance, specifically an application material 111 on the ground surface 131.

Having thus described in detail a preferred selection of embodiments of the present invention, it is to be appreciated, and will be apparent to those skilled in the art, that many physical changes could be made in the apparatus or method without altering the invention, or the concepts and principles embodied therein.

Unless otherwise specifically stated, the terms and expressions have been used herein as terms of description and not terms of limitation, and are not intended to exclude any equivalents of features shown and described or portions thereof. Various changes can, of course, be made to the preferred embodiment without departing from the spirit and scope of the present invention. The present invention apparatus and method, therefore, should not be restricted, except in the following claims and their equivalents.

Although specific advantages have been enumerated above, various embodiments may include some, none, or all of the enumerated advantages.

Other technical advantages may become readily apparent to one of ordinary skill in the art after review of the foregoing figures and description.

It should be understood at the outset hat, although exemplary embodiments are illustrated in the figures and described herein, the principles of the present disclosure may be implemented using any number of techniques, whether currently known or not. The present disclosure should in no way be limited to the exemplary implementations and techniques illustrated in the drawings and described herein.

Unless otherwise specifically noted, articles depicted in the drawings are not necessarily drawn to scale.

Modifications, additions, or omissions may be made to the systems, devices, apparatuses, and methods described herein without, departing from the scope of the disclosure. For example, the components of the systems, devices, and apparatuses may be integrated or separated. Moreover, the operations of the systems, devices and apparatuses disclosed herein may be performed by more, fewer, or other components, and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

This patent will not limit us to just the said verbiage but have the flexibility to be able to utilize these concepts for many applications and many industries.

We claim:

1. A material handling bucket apparatus comprising:

(a) a material handling bucket comprising: a bucket front half and an opposing bucket back half, a left bucket side and an opposing right bucket side;

(b) the bucket front half comprising: a pair of front pivotally connecting points, a convexing front clam surface rigidly attaching to a left clam side and an opposing right clam side, a lower edge, and a left clam inside and an opposing right clam inside;

(c) the opposing bucket back half comprising: a back half left panel and an opposing back half right panel rigidly attaching to a dozer surface panel, the dozer surface panel comprising: a dozer bottom, an adjacent dozer back, and a dozer scraping lip running lengthwise along the dozer bottom;

(d) the dozer surface panel, the back half left panel, and the opposing back half right panel configuring to hold application material and defining an open top/front side to the opposing bucket back half;

(e) a horizontally sliding mechanism securedly, integratingly, and cooperatively adjoining the bucket front half with the opposing bucket back half allowing the bucket front half to slide horizontally and cooperatively with respect to the opposing bucket back half;

(f) the opposing bucket back half further comprising: a plurality of loader attaching holes and a plurality of loader attachment means;

(g) the opposing bucket back half locating immediately, snugly, cooperatively, freely, and pivotally within the bucket front half;

(h) a loader comprising: a loader tractor, a pair of loader operating lifting arms, a pair of loader operating tilt arms, a hydraulic power unit, a pair of loader attaching points, a pair of tilt attaching points, and a power source;

(i) the plurality of loader attachment means securely and operationally attaching the pair of loader operating lifting arms to the opposing bucket back half through the plurality of loader attaching holes at the pair of loader attaching points, respectively;

(j) the plurality of loader attachment means securely and operationally attaching the pair of loader operating tilt arms to the opposing bucket back half through the plurality of loader attaching holes at the pair of tilt attaching points, respectively;

(k) a pair of linkage systems pivotally and cooperatively joined to the bucket front half, respectively at the pair of front pivotally connecting points by a pair of front connecting pins, the pair of linkage systems comprising: a pair of front bucket actuating cylinders;

(l) the pair of loader operating lifting arms to the loader each located proximally on the left bucket side and the opposing right bucket side, respectively, and attaching to and operating the opposing bucket back half of the material handling bucket by the plurality of loader attachment means;

(m) the pair of loader operating tilt arms locating between the pair of loader operating lifting arms and attaching to and operating the opposing bucket back half by the plurality of loader attachment means;

(n) the bucket front half operating and moving in a pivoting manner around the pair of front pivotally connecting points, pivoting over and forward of the open top/front side of the opposing bucket back half;

(o) a ground surface having application material;

(p) the horizontally sliding mechanism allowing the bucket front half to pivot and to advance forward, backward, upward and downward with respect to the opposing bucket back half;

(q) the loader tractor to the loader providing power from the power source to the pair of loader operating tilt arms and to the pair of loader operating lifting arms through a plurality of power lines;

(r) the hydraulic power unit in the loader tractor providing hydraulic power through a pair of hydraulic power lines to the pair of front bucket actuating cylinders thereby operating the pair of linkage systems;

(s) the pair of linkage systems operating, driving, and laterally moving the bucket front half forward beyond the dozer scraping lip of the opposing bucket back half allowing the convexing clam front surface to engage, scoop and haul the application material backward onto the dozer surface panel of the opposing bucket back half;

(t) the loader operating the opposing bucket back half cooperatively through the pair of loader operating tilt arms tipping the opposing bucket back half up and down to load and dump the application material, and through the pair of loader operating lifting arms, lifting, pivoting, pushing and pulling the opposing bucket back half forward, backward, upward and downward;

(u) the loader moving along the ground surface in a travel direction allowing the dozer scraping lip to advance on the ground surface scraping up and gathering the application material onto the dozer surface panel, and pivoting the opposing bucket back half to haul the application material which is carried on the dozer surface panel; and (v) the power source in the loader generating and providing power to power and move the loader tractor, to move the pair of loader operating tilt arms and the pair of loader operating lifting arms, and to operate the hydraulic power unit, thereby causing the material handling bucket to operate.

2. The material handling bucket apparatus of claim 1, wherein the application material comprises at least one of: earth, asphalt, concrete, snow, aggregate, dirt, mulch or other landscaping material.

3. The material handling bucket apparatus of claim 1, wherein the power source comprising:

(a) at least one of: electrical, gas, or hydraulic power; and (b) a control means comprising: a control circuit and controls.

4. The material handling bucket apparatus of claim 1 further comprising: a pair of side gates locating and freely attaching, respectively to the left bucket side and the opposing right bucket side of the opposing bucket back half.

5. The material handling bucket apparatus of claim 1; wherein the pair of linkage systems comprising:

(a) a pair of front linkage arms; a pair of central linkage arms, a pair of rear linkage arms, and a plurality of linkage lugs;

(b) the pair of front linkage arms cooperatively and pivotally connecting, respectively to the bucket front half by the pair of front connecting pins locating at the pair of front pivotally connecting points;

(c) the pair of central linkage arms in turn further cooperatively and pivotally connecting, respectively to the pair of rear linkage arms at a pair of central linkage points by the plurality of linkage lugs;

(d) the pair of rear linkage arms in turn further cooperatively and pivotally connecting, respectively to the pair of front bucket actuating cylinders at a pair of cylinder linkage points by the plurality of linkage lugs; and (e) the pair of front bucket actuating cylinders thereby operating the pair of linkage systems causing the pair of front linkage arms; the pair of central linkage arms, and the pair of rear linkage arms to connectively and cooperatively pivotally operate the front bucket half.

6. The material handling bucket apparatus of claim 1; wherein the pair of front connecting pins comprising: a plurality of securing pins and bearings.

7. The material handling bucket apparatus of claim 1; wherein the plurality of loader attachment means comprising at least one of: pins and lugs, quick hitches, or hydraulic pins.

8. The material handling bucket apparatus of claim 1, wherein the opposing bucket back half further comprising: a plurality of access slots facilitating the connection of the pair of the hydraulic lines to the pair of front bucket actuating cylinders.

9. The material handling bucket apparatus of claim 1, wherein the horizontally sliding mechanism comprising:

(a) a plurality of secured horizontally sliding pins, locating within the bucket front half, each of the plurality of secured horizontally sliding pins attaching permanently to the left clam inside and the opposing right clam inside, respectively of the bucket front half;

(b) a plurality of substantially horizontal sliding slots locating through the back half left panel and the opposing back half right panel to the opposing bucket back half;

(c) each of the plurality of secured horizontally sliding pins, respectively, locating and engaging, cooperatively within one of the plurality of substantially horizontal sliding slots through the opposing bucket back half;

(d) the plurality of secured horizontally sliding pins slidingly locating within and freely engaging, cooperatively the plurality of substantially horizontal sliding slots; and (e) the plurality of substantially horizontal sliding slots allowing and providing horizontal and pivotal movement of the plurality of secured horizontally sliding pins within the plurality of substantially horizontal sliding slots, thereby allowing the bucket front half to pivot and to advance forward, backward, upward and downward with respect to the opposing bucket back half.

10. The horizontally sliding mechanism of claim 9, wherein the plurality of secured horizontally sliding pins comprising: a plurality of pin bearings allowing for easy horizontal movement of the plurality of secured horizontally sliding pins within the plurality of substantially horizontal sliding slots.

11. The pair of side gates of claim 4 further comprising:

(a) being located and freely attached, respectively to the left bucket side and the opposing right bucket side by a pair of side gate adjuster bars;

(b) each of the pair of side gate adjuster bars comprising: a plurality of substantially vertical sliding slots and a pair of bar attachment portions integrally and partially attaching the pair of side gate adjuster bars to the opposing bucket back half;

(c) a plurality of secured vertical sliding pins permanently fixed to the left bucket side and the opposing right bucket side, respectively of the opposing bucket back half;

(d) each of the plurality of secured vertical sliding pins, respectively, locating and engaging, cooperatively within one of the plurality of substantially vertical sliding slots through one of the respective pair of side gate adjuster bars;

(e) a pair of stabilizer bars each having, respectively, one of a pair of stabilizer attaching ends and one of a pair of opposing gate attaching ends;

(0 each of the pair of stabilizer bars cooperatively and operatively attaching to the loader tractor by the plurality of loader attachment means at the pair of stabilizer attaching ends, respectively, and cooperatively, operatively securing to each of the pair of side gates at the pair of opposing gate attaching ends, respectively;

(g) the plurality of power lines providing power to the pair of stabilizer bars;

(h) the pair of stabilizer bars freely supporting, stabilizing and operating the pair of side gates independent of the bucket front half and the opposing bucket back half, the pair of side gates orienting horizontally in proximity to the ground surface; and (i) whereby the pair of side gates restricting movement of and neatly containing the application material within the opposing bucket back half.

12. A material handling bucket apparatus comprising:

(a) a loader comprising: a loader tractor, a boom, a hydraulic power unit, and a power source;

(b) a material handling bucket comprising: a bucket front half and an opposing bucket back half, a left bucket side and an opposing right bucket side;

(c) the bucket front half comprising: a pair of front pivotally connecting points, a convexing clam front surface, and a left clam side and an opposing right clam side, a lower edge, and a left clam inside and an opposing right clam inside;

(d) the opposing bucket back half comprising: a back half left panel and an opposing back half right panel rigidly attaching to a dozer surface panel, the dozer surface panel having a dozer bottom, an adjacent dozer back, and a dozer scraping lip running lengthwise along the dozer bottom;

(e) the dozer surface panel, the back half left panel, and the opposing back half right panel defining an open top/front side to the opposing bucket back half;

(f) a horizontally sliding mechanism securedly, integratingly and cooperatively adjoining the bucket front half with the opposing bucket back half allowing the bucket front half to slide horizontally and cooperatively with respect to the opposing bucket back half;

(g) a pair of linkage systems pivotally and cooperatively joined to the bucket front half, respectively, at the pair of front pivotally connecting points by a pair of front connecting pins;

(h) the opposing bucket back half further comprising: a plurality of loader attaching holes, and a plurality of loader attachment means;

(i) the opposing bucket back half locating immediately, snugly, cooperatively, freely, and pivotally within the bucket front half;

(j) the bucket front half operating and moving in a pivoting manner around the pair of front pivotally connecting points, pivoting over and forward of the open top/front side of the opposing bucket back half;

(k) a ground surface having application material;

(l) the horizontally sliding mechanism allowing the bucket front half to pivot and to advance forward, backward, upward and downward with respect to the opposing bucket back half;

(m) the loader tractor to the loader providing power from the power source to the boom through a plurality of power lines;

(n) the hydraulic power unit in the loader tractor providing hydraulic power through a pair of hydraulic power lines to the pair of front bucket actuating cylinders to operate the pair of linkage systems;

(o) the pair of linkage systems operating, driving and laterally moving the bucket front half forward beyond the dozer scraping lip of the opposing bucket back half allowing the convexing clam front surface to engage, scoop and haul the application material from a ground surface backward onto the dozer surface panel of the opposing bucket back half;

(p) the boom operationally and attachedly located between the loader tractor and the opposing bucket back half, and attaching to and operating the opposing bucket back half;

(q) the loader operating the opposing bucket back half cooperatively through the boom tipping the opposing bucket back half up and down to dump the application material, and through the pair of loader to operate the lifting arms, and lift, pivot, push, and pull the opposing bucket back half forward, backward, upward and downward;

(r) the loader moving along the ground surface in a travel direction allowing the dozer scraping lip to advance on the ground surface to scrape up and gather application material onto the dozer surface panel, and to pivot the opposing bucket back half to haul the application material carried on the dozer surface panel; and (s) the power source in the loader generating and providing power to power and move the loader tractor, to move the boom, and to operate the hydraulic power unit.

13. The material handling bucket apparatus of claim 12, further comprising:

(a) the boom having: a pair of loader operating lifting arms, a pair of loader operating tilt arms, a pair of loader attaching points, and a pair of tilt attaching points;

(b) the plurality of loader attachment means securely and operationally attaching the pair of loader operating lifting arms to the opposing bucket back half through the plurality of loader attaching holes at the pair of loader attaching points, respectively;

(c) the plurality of loader attachment means securely and operationally attaching the pair of loader operating tilt arms to the opposing bucket back half through the plurality of loader attaching holes at the pair of tilt attaching points, respectively;

(d) the pair of loader operating lifting arms each located proximally to the left bucket side and the opposing right bucket side, respectively, and attaching to and operating the opposing bucket back half of the material handling bucket by the plurality of loader attachment means;

(e) the pair of loader operating tilt arms locating between the pair of loader operating lifting arms and attaching to and operating the opposing bucket back half by the plurality of loader attachment means; and (f) the loader operating the opposing bucket back half cooperatively through the pair of loader operating tilt arms to the boom, tipping the opposing bucket back half up and down to dump the application material, and through the pair of loader operating lifting arms to the boom, lifting, pivoting, pushing and pulling the opposing bucket back half forward, backward, upward and downward.

14. The material handling bucket apparatus of claim 12, wherein the application material comprises at least one of: earth, asphalt, concrete, snow, aggregate, dirt, mulch or other landscaping material.

15. The material handling bucket apparatus of claim 12, wherein the power source comprising:

(a) at least one of: electrical, gas, or hydraulic power; and (b) a control means comprising: a control circuit and controls.

16. The material handling bucket apparatus of claim 12 further comprising:

(a) a pair of side gates locating and freely attaching, respectively to the left bucket side and the opposing right bucket side of the opposing bucket back half by a pair of side gate adjuster bars;

(b) each of the pair of side gate adjuster bars comprising: a plurality of substantially vertical sliding slots and a pair of bar attachment portions integrally and partially attaching the pair of side gate adjuster bars to the opposing bucket back half;

(c) a plurality of secured vertical sliding pins permanently fixed to the left bucket side and the opposing right bucket side, respectively of the opposing bucket back half;

(d) each of the plurality of secured vertical sliding pins, respectively, locating and engaging, cooperatively within one of the plurality of substantially vertical sliding slots through one of the respective pair of side gate adjuster bars;

(e) a pair of stabilizer bars each having, respectively, one of a pair of stabilizer attaching ends and one of a pair of opposing gate attaching ends;

(f) each of the pair of stabilizer bars cooperatively and operatively attaching to the loader tractor by the plurality of loader attachment means at the pair of stabilizer attaching ends, respectively, and cooperatively, operatively securing to each of the pair of side gates at the pair of opposing gate attaching ends, respectively;

(g) the plurality of power lines providing power to the pair of stabilizer bars;

(h) the pair of stabilizer bars freely supporting, stabilizing and operating the pair of side gates independent of the bucket front half and the opposing bucket back half, the pair of side gates orienting horizontally in proximity to the ground surface; and (i) whereby the pair of side gates restricting movement of and neatly containing the application material within the opposing bucket back half.

17. The material handling bucket apparatus of claim 12; wherein the pair of linkage systems comprising:

(a) a pair of front linkage arms; a pair of central linkage arms, a pair of rear linkage arms, and a plurality of linkage lugs;

(b) the pair of front linkage arms cooperatively and pivotally connecting, respectively to the bucket front half by the pair of front connecting pins locating at the pair of front pivotally connecting points;

(c) the pair of central linkage arms in turn further cooperatively and pivotally connecting, respectively to the pair of rear linkage arms at a pair of central linkage points by the plurality of linkage lugs;

(d) the pair of rear linkage arms in turn further cooperatively and pivotally connecting, respectively to the pair of front bucket actuating cylinders at a pair of cylinder linkage points by the plurality of linkage lugs;

(e) the hydraulic power unit in the loader tractor providing hydraulic power through the pair of hydraulic power lines operating the pair of linkage systems and, in turn, operating the pair of front bucket actuating cylinders; and (f) the pair of front bucket actuating cylinders thereby operating the pair of linkage systems causing the pair of front linkage arms; the pair of central linkage arms, and the pair of rear linkage arms to connectively and cooperatively pivotally operate the front bucket half.

18. The material handling bucket apparatus of claim 12; wherein the pair of front connecting pins comprising: a plurality of securing pins and bearings.

19. The material handling bucket apparatus of claim 12; wherein the plurality of loader attachment means comprising at least one of: pins and lugs, quick hitches, or hydraulic pins.

20. The material handling bucket apparatus of claim 12; wherein the opposing bucket back half further comprising: a plurality of access slots facilitating the connection of the pair of the hydraulic lines to the pair of front bucket actuating cylinders.

21. The material handling bucket apparatus of claim 12, wherein the horizontally sliding mechanism comprising:

(a) a plurality of secured horizontally sliding pins, locating within the bucket front half, each of the plurality of secured horizontally sliding pins attaching permanently to the left clam inside and the opposing right clam inside, respectively of the bucket front half;

(b) a plurality of substantially horizontal sliding slots locating through the back half left panel and the opposing back half right panel to the opposing bucket back half;

(c) each of the plurality of secured horizontally sliding pins, respectively, locating and engaging, cooperatively within one of the plurality of substantially horizontal sliding slots through the opposing bucket back half;

(d) the plurality of secured horizontally sliding pins slidingly locating within and freely engaging, cooperatively the plurality of substantially horizontal sliding slots; and (e) the plurality of substantially horizontal sliding slots allowing and providing horizontal and pivotal movement of the plurality of secured horizontally sliding pins within the plurality of substantially horizontal sliding slots, thereby allowing the bucket front half to pivot and to advance forward, backward, upward and downward with respect to the opposing bucket back half.

22. The horizontally sliding mechanism of claim 21; the plurality of secured horizontally sliding pins comprising: a plurality of pin bearings allowing for easy horizontal movement of the plurality of secured horizontally sliding pins within the plurality of substantially horizontal sliding slots.

23. A method for handling application material with a loader, the method comprising:

(a) having a loader comprising: a loader tractor, a boom, a hydraulic power unit, a material handling bucket, a pair of linkage systems, and a power source, and having the power source comprising: at least one of: electrical, gas, or hydraulic power;

(b) operating the power source with a control means;

(c) providing the material handling bucket with a bucket front half and an opposing bucket back half, and moving the bucket front half independently of the opposing bucket back half;

(d) providing the bucket front half with a pair of front pivotally connecting points, a convexing clam front surface, and a left clam side and an opposing right clam side, and a lower edge;

(e) providing the opposing bucket back half with a dozer bottom and a dozer scraping lip having a sharp scraping edge and running the dozer scraping lip lengthwise along the dozer bottom;

(0 pivotally and cooperatively joining the pair of linkage systems to the bucket front half, respectively at the pair of front pivotally connecting points;

(g) providing the opposing bucket back half with a plurality of loader attaching holes and a plurality of loader attachment means, and having the plurality of loader attachment means comprising at least one of: pins and lugs, quick hitches, or hydraulic pins;

(h) installing a horizontally sliding mechanism securedly, integratingly and cooperatively adjoining the bucket front half with the opposing bucket back half allowing the bucket front half to slide horizontally and cooperatively with respect to the opposing bucket back half;

(i) operating and moving the bucket front half in a pivoting manner around the pair of front pivotally connecting points, pivoting over and forward of a open top/front side of the opposing bucket back half;

(j) allowing the bucket front half to pivot and to advance forward, backward, upward and downward with respect to the opposing bucket back half by allowing and providing horizontal and pivotal movement from the horizontally sliding mechanism;

(k) providing hydraulic power from the hydraulic power unit through a pair of hydraulic power lines to operate the pair of linkage systems;

(l) operating, driving and laterally moving the bucket front half forward beyond the opposing bucket back half with the pair of linkage systems, and allowing the convexing clam front surface to engage, scoop and haul application material from a ground surface backward onto the opposing bucket back half;

(m) operationally and attachedly locating the boom between the loader tractor and the opposing bucket half;

(n) attaching the boom to the opposing bucket back half at the plurality of loader attachment means;

(o) operating the opposing bucket back half with the loader cooperatively through the boom and tipping the opposing bucket back half up and down to dump the application material;

(p) using the boom to lift, pivot, push and pull the opposing bucket back half forward, backward, upward and downward;

(q) moving the loader along the ground surface in a travel direction allowing the dozer scraping lip to advance on the ground surface scraping up and gathering application material onto the dozer bottom panel, and pivoting the opposing bucket back half to haul the application material which is carried on the dozer bottom panel;

(r) locating and freely attaching a pair of side gates, respectively, to the left bucket side and the opposing right bucket side of the opposing bucket back half;

(s) cooperatively and operatively attaching to the loader tractor a pair of stabilizer bars by the plurality of loader attachment means, respectively, and cooperatively, operatively securing each of the pair of stabilizer bars by the plurality of loader attachment means to each of the pair of side gates, respectively;

(t) freely supporting, stabilizing and operating the pair of side gates independent of the bucket front half and the opposing bucket back half, and orienting the pair of side gates horizontally in proximity to the ground surface;

(u) restricting movement of and neatly containing the application material within the opposing bucket back half with the pair of side gates; and (v) generating and providing power from the power source in the loader to power and move the loader tractor, to move the boom and to operate the hydraulic power unit, and causing the material handling bucket to operate.

24. The method for handling application material with a loader of claim 23; wherein the pair of linkage systems comprising:

(a) having a pair of front linkage arms; a pair of central linkage arms, a pair of rear linkage arms, a plurality of linkage lugs, a pair of front bucket actuating cylinders, and a pair of hydraulic lines;

(b) cooperatively and pivotally connecting the pair of front linkage arms, respectively, to the bucket front half by a pair of front connecting pins locating at the pair of front pivotally connecting points;

(c) further cooperatively and pivotally connecting, in turn, the pair of central linkage arms, respectively, to the pair of rear linkage arms at a pair of central linkage points by the plurality of linkage lugs;

(d) further cooperatively and pivotally connecting, in turn, the pair of rear linkage arms, respectively to the pair of front bucket actuating cylinders at a pair of cylinder linkage points by the plurality of linkage lugs;

(e) providing hydraulic power from the hydraulic power unit in the loader tractor through the pair of hydraulic power lines operating the pair of front bucket actuating cylinders and, in turn, operating the pair of linkage systems; and (f) the pair of front bucket actuating cylinders operating the pair of linkage systems causing the pair of front linkage arms; the pair of central linkage arms, and the pair of rear linkage arms to connectively and cooperatively pivotally operate the front bucket half.

25. The method for handling surface material with a loader of claim 23, wherein the control means comprising: a control circuit and controls.

26. The method for handling application material with a loader of claim 23, wherein the application material comprising at least one of: earth, asphalt, concrete, snow, aggregate, dirt, mulch or other landscaping material.

27. The method for handling application material with a loader of claim 23, wherein the horizontally sliding mechanism comprising:

(a) attaching each of the plurality of secured horizontally sliding pins permanently to the left clam inside and the opposing right clam inside, respectively of the bucket front half;

(b) providing a plurality of substantially horizontal sliding slots through the back half left panel and the opposing back half right panel of the opposing bucket back half;

(c) locating and engaging each of the plurality of secured horizontally sliding pins, respectively, cooperatively within one of the plurality of substantially horizontal sliding slots through the opposing bucket back half;

(d) slidingly locating and freely engaging the plurality of secured horizontally sliding pins, cooperatively within the plurality of substantially horizontal sliding slots; and (e) allowing and providing horizontal and pivotal movement of the plurality of secured horizontally sliding pins within the plurality of substantially horizontal sliding slots, thereby allowing the bucket front half to pivot and to advance forward, backward, upward and downward with respect to the opposing bucket back half.

28. A method for handling application material with a loader, the method comprising:

(a) having a loader comprising: a loader tractor, a boom, a material handling bucket, a pair of linkage systems, and a power source;

(b) operating the power source with a control means comprising; a control circuit and controls;

(c) providing the material handling bucket with a bucket front half and an opposing bucket back half;

(d) operationally and attachedly locating the boom between the loader tractor and the opposing bucket back half;

(e) locating the opposing bucket back half snugly, pivotally, and freely moving within the bucket front half;

(f) providing the opposing bucket back half with a dozer bottom and a dozer scraping lip;

(g) operatively connecting the bucket front half to the loader by the pair of linkage systems;

(h) operatively connecting the boom to the opposing bucket back half;

(i) installing a horizontally sliding mechanism securedly, integratingly and cooperatively adjoining the bucket front half with the opposing bucket back half allowing the bucket front half to slide horizontally and cooperatively with respect to the opposing bucket back half;

(j) operating and moving the bucket front half by the pair of linkage systems in a pivoting and lateral manner, pivoting over and forward of the opposing bucket back half;

(k) allowing and providing horizontal and pivotal movement by the horizontally sliding mechanism causing the bucket front half to pivot and to advance forward, backward, upward and downward with respect to the opposing bucket back half;

(l) operating, driving and laterally moving the bucket front half forward beyond the opposing bucket back half and allowing the bucket front half to engage, scoop and haul application material from a ground surface backward onto the opposing bucket back half;

(m) operating the opposing bucket back half with the loader cooperatively through the boom and tipping the opposing bucket back half up and down to load and dump the application material;

(n) using the boom to lift, pivot, push and pull the opposing bucket back half forward, backward, upward and downward;

(o) moving the loader along the ground surface in a travel direction advancing the dozer scraping lip on the ground surface scraping up and gathering application material into the opposing bucket back half, and pivoting the opposing bucket back half to haul the application material;

(p) locating and freely attaching a pair of side gates, respectively, to the left bucket side and the opposing right bucket side of the opposing bucket back half;

(q) cooperatively and operatively attaching to the loader tractor a pair of stabilizer bars, and cooperatively, operatively securing each of the pair of stabilizer bars to each of the pair of side gates, respectively;

(r) freely supporting, stabilizing and operating the pair of side gates independent of the bucket front half and the opposing bucket back half, and horizontally orienting the pair of side gates in proximity to the ground surface;

(s) restricting movement of and neatly containing the application material within the opposing bucket back half with the pair of side gates;

(t) operating the pair of linkage systems by providing hydraulic power from a hydraulic power unit through a pair of hydraulic power lines; and (u) generating and providing power from the power source in the loader, moving the loader tractor, operating the hydraulic power unit, operating the boom, and causing the material handling bucket to operate.

29. The method for handling application material with a loader of claim 28; wherein the pair of linkage systems comprising:

(a) having a pair of front linkage arms; a pair of central linkage arms, a pair of rear linkage arms, a plurality of linkage lugs, a pair of front bucket actuating cylinders, and a pair of hydraulic lines;

(b) cooperatively and pivotally connecting the pair of front linkage arms, respectively, to the bucket front half by a pair of front connecting pins locating at a pair of front pivotally connecting points;

(c) further cooperatively and pivotally connecting, in turn, the pair of central linkage arms, respectively, to the pair of rear linkage arms at a pair of central linkage points by the plurality of linkage lugs;

(d) further cooperatively and pivotally connecting, in turn, the pair of rear linkage arms, respectively to the pair of front bucket actuating cylinders at a pair of cylinder linkage points by the plurality of linkage lugs;

(e) providing hydraulic power from the hydraulic power unit in the loader tractor through the pair of hydraulic power lines operating the pair of front bucket actuating cylinders and, in turn, operating the pair of linkage systems; and (f) the pair of front bucket actuating cylinders operating the pair of linkage systems causing the pair of front linkage arms; the pair of central linkage arms, and the pair of rear linkage arms to connectively and cooperatively pivotally operate the front bucket half.

30. The method for handling application material with a loader of claim 28, wherein the application material comprises at least one of: earth, asphalt, concrete, snow, aggregate, dirt, mulch or other landscaping material.

* * * * *